US011149946B2

(12) United States Patent
Super et al.

(10) Patent No.: US 11,149,946 B2
(45) Date of Patent: Oct. 19, 2021

(54) SYSTEM AND APPROACH FOR CONTROLLING A COMBUSTION CHAMBER

(71) Applicant: Honeywell International Inc., Morris Plains, NJ (US)

(72) Inventors: Willem Super, Emmen (NL); Peter Vermass, Drenthe (NL); Hans M. van der Mei, Oosterhesselen (NL); Roelof Thiewes, Odoorn (NL); Donald J. Kasprzyk, Maple Grove, MN (US); Gregory Young, Richfield, MN (US)

(73) Assignee: Honeywell International Inc., Charlotte, NC (US)

( * ) Notice: Subject to any disclaimer, the term of this patent is extended or adjusted under 35 U.S.C. 154(b) by 113 days.

(21) Appl. No.: 16/435,771

(22) Filed: Jun. 10, 2019

(65) Prior Publication Data

US 2019/0293286 A1 Sep. 26, 2019

Related U.S. Application Data

(60) Division of application No. 14/485,519, filed on Sep. 12, 2014, now Pat. No. 10,317,076, which is a (Continued)

(51) Int. Cl.

| | |
|---|---|
| ***F23N 1/02*** | (2006.01) |
| ***F23N 5/18*** | (2006.01) |
| ***F23N 1/00*** | (2006.01) |

(52) U.S. Cl.

CPC ..... *F23N 1/022* (2013.01); *F23N 1/002* (2013.01); *F23N 5/184* (2013.01); *F23N 2225/06* (2020.01); *F23N 2900/05181* (2013.01)

(58) Field of Classification Search

CPC . F23N 5/18; F23N 1/022; F23N 1/002; F23N 5/184

See application file for complete search history.

(56) References Cited

U.S. PATENT DOCUMENTS

| | | | |
|---|---|---|---|
| 4,613,072 | A | 9/1986 | Kikuchi et al. |
| 5,520,533 | A | 5/1996 | Vroliijk |

(Continued)

FOREIGN PATENT DOCUMENTS

| | | | |
|---|---|---|---|
| EP | 1084369 | B1 | 1/2003 |
| EP | 1230517 | B1 | 7/2013 |

(Continued)

OTHER PUBLICATIONS

The European Search Report for EP Application No. 15184490.9 dated May 3, 2016.

(Continued)

*Primary Examiner* — Steven B McAllister
*Assistant Examiner* — Aaron H Heyamoto
(74) *Attorney, Agent, or Firm* — Seager, Tufte & Wickhem, LLP

(57) ABSTRACT

A system for controlling activity in a combustion chamber. The system does not necessarily need to be mechanically adjusted and yet may provide precise control of a fuel air mixture ratio. A sensing module of the system may have a mass flow sensor that relates to air flow and another sensor that relates to fuel flow. Neither sensor may need contact with fuel. Fuel and air to the system may be controlled. Pressure of the fuel and/or air may be regulated. The sensors may provide signals to a processor to indicate a state of the fuel and air in the system. The processor, with reliance on a programmed curve, table or the like, often based on data, in a storage memory, may regulate the flow or pressure of the (Continued)

fuel and air in a parallel fashion to provide an appropriate fuel-air mixture to the combustion chamber.

10 Claims, 15 Drawing Sheets

Related U.S. Application Data continuation-in-part of application No. 13/621,175, filed on Sep. 15, 2012, now Pat. No. 9,234,661.

(56) References Cited

U.S. PATENT DOCUMENTS

| | | | | |
|---|---|---|---|---|
| 6,533,574 | B1 | 3/2003 | Pechoux | |
| 7,922,481 | B2 | 4/2011 | Geiger et al. | |
| 8,601,957 | B2 | 12/2013 | Conrads et al. | |
| 8,706,381 | B2 | 4/2014 | Donar et al. | |
| 2010/0330520 | A1* | 12/2010 | Kanda | F23D 14/60 431/350 |
| 2011/0033808 | A1 | 2/2011 | Geiger et al. | |
| 2011/0107826 | A1 | 5/2011 | Wallis | |
| 2011/0126816 | A1* | 6/2011 | Salbide Mutiloa | F23N 5/245 126/42 |
| 2011/0212404 | A1* | 9/2011 | Fan | F23N 1/082 431/12 |
| 2012/0148962 | A1 | 6/2012 | Bernero et al. | |
| 2013/0302738 | A1 | 11/2013 | Rennie et al. | |
| 2014/0080075 | A1 | 3/2014 | Young et al. | |
| 2014/0150445 | A1 | 6/2014 | Huntington et al. | |
| 2015/0079526 | A1* | 3/2015 | Lou | F23L 7/007 431/12 |

FOREIGN PATENT DOCUMENTS

| | | | |
|---|---|---|---|
| GB | 1571906 | A | 7/1980 |
| WO | 2013117516 | A1 | 8/2013 |

OTHER PUBLICATIONS

The Extended European Search Report for EP Application No. 16185928.5, dated Jun. 20, 2017.

* cited by examiner

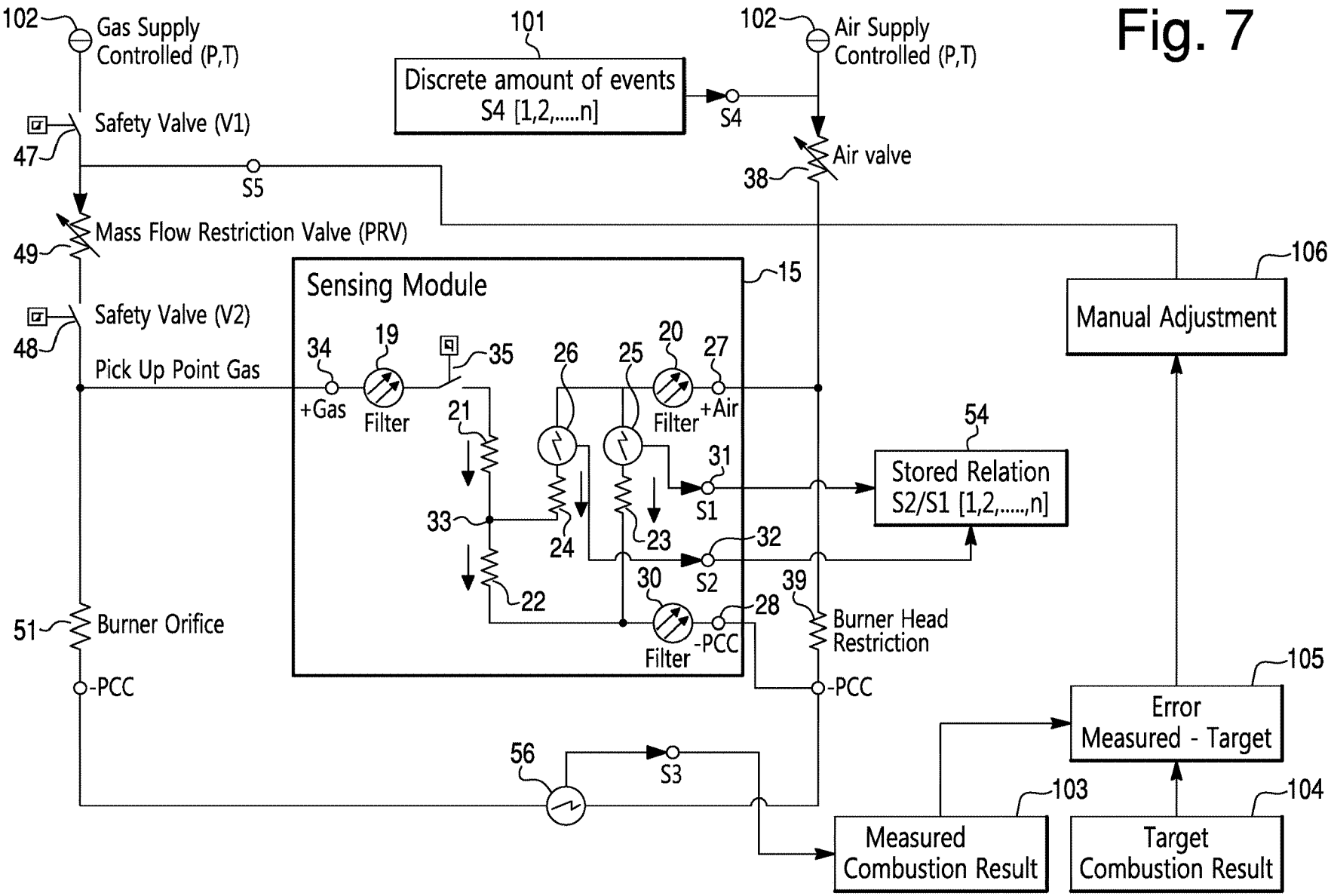
Fig. 7
Manual Adjustment
106
Error
Measured - Target
105
Target
Combustion Result
104
Measured
Combustion Result
103
Stored Relation
S2/S1 [1,2,....,n]
54
Air Supply
Controlled (P,T)
102
Air valve
38
S4
Discrete amount of events
S4 [1,2,....n]
101
Burner Head
Restriction
39
-PCC
15
Sensing Module
+Air
27
20
Filter
25
26
31
S1
32
S2
28
-PCC
30
Filter
23
24
22
35
21
33
19
Filter
34
+Gas
S3
56
Gas Supply
Controlled (P,T)
102
Safety Valve (V1)
47
S5
Mass Flow Restriction Valve (PRV)
49
Safety Valve (V2)
48
Pick Up Point Gas
Burner Orifice
51
-PCC

SYSTEM AND APPROACH FOR CONTROLLING A COMBUSTION CHAMBER

This application is a divisional application of U.S. patent application Ser. No. 14/485,519, filed Sep. 12, 2014, entitled "System and Approach for Controlling a Combustion Chamber", which is a continuation-in-part of U.S. patent application Ser. No. 13/621,175, filed Sep. 15, 2012, and entitled "Burner Control System". U.S. patent application Ser. No. 13/621,175, filed Sep. 15, 2012, is hereby incorporated by reference. U.S. patent application Ser. No. 14/485,519, filed Sep. 12, 2014, is hereby incorporated by reference.

BACKGROUND

The present disclosure pertains to combustion devices, for example, burners. Particularly, the disclosure pertains to controlling combustion in the devices.

SUMMARY

The disclosure reveals a system and approach for controlling activity in a combustion chamber, such as a burner. The system does not necessarily need to be mechanically adjusted and yet may provide precise control of a fuel air mixture ratio. A sensing module of the system may have a mass flow sensor that relates to air flow and another sensor that relates to fuel flow. Neither sensor may need contact with fuel. Fuel to the system may be controlled, for example, by a mass flow restriction valve. Pressure of the fuel and air may be a regulated parameter. Air to the system may be controlled as a reference. The sensors may provide signals to a processor to indicate a state of the fuel and air in the system. The processor, with reliance on a programmed curve, table or the like, often based on data, in a storage memory, may regulate the flow or pressure of the fuel and air in a parallel fashion to provide an appropriate fuel-air mixture to the combustion chamber in various situations relative to burner capacity, setpoints, commissioning, purge, and so on.

BRIEF DESCRIPTION OF THE DRAWING

FIG. 7 is a diagram of a third operating condition for the regulation system;

DESCRIPTION

Figure 1:
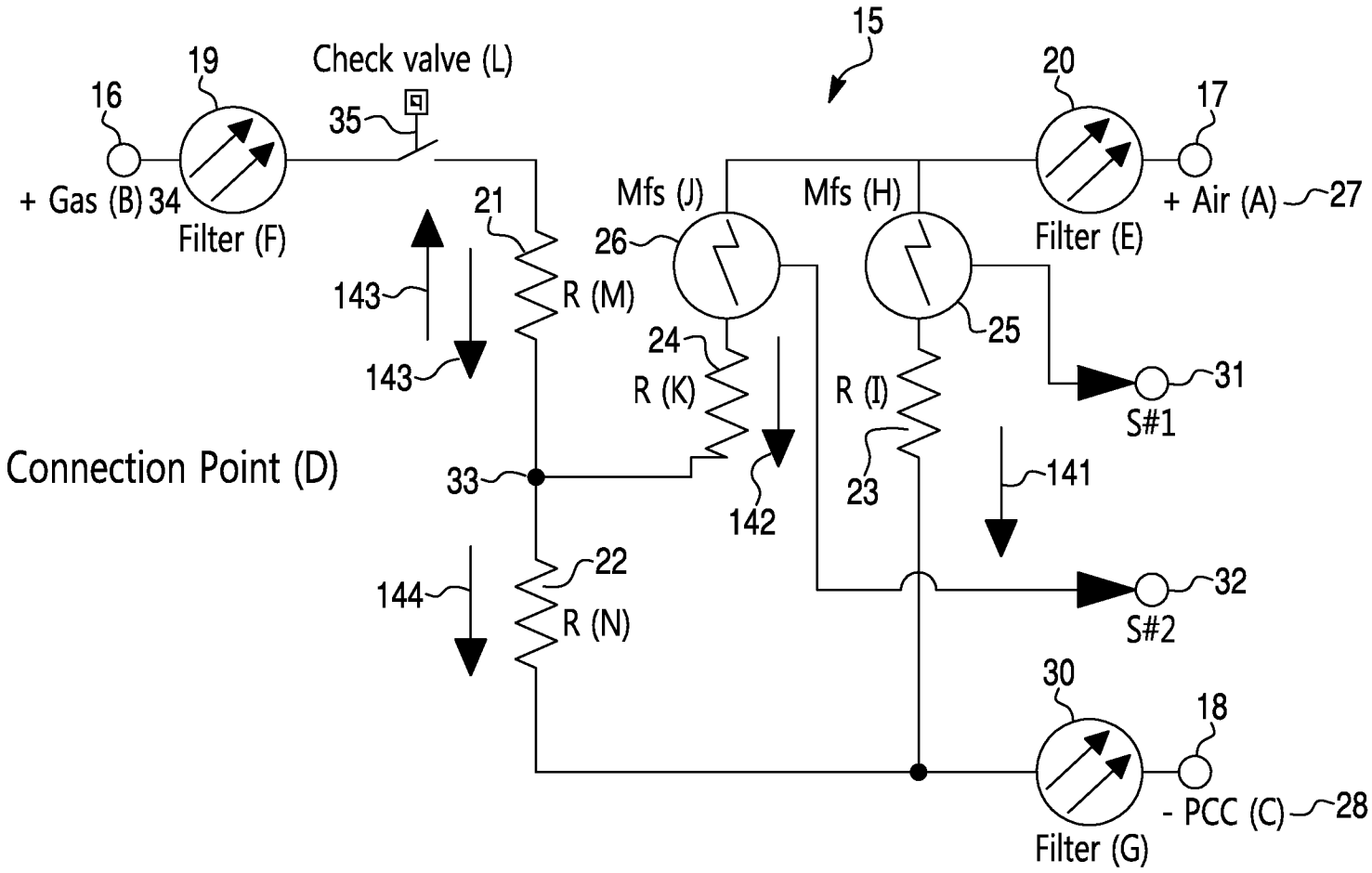
FIG. 1 is a diagram of a measurement system that may provide signals for fuel regulation.

The present system and approach may incorporate one or more processors, computers, controllers, user interfaces, wireless and/or wire connections, and/or the like, in an implementation described and/or shown herein.

This description may provide one or more illustrative and specific examples or ways of implementing the present system and approach. There may be numerous other examples or ways of implementing the system and approach.

The present approach and system may feature a pneumatic connection between a reference air pressure, a reference combustion chamber pressure and a regulated fuel pressure. The pneumatic connection may contain flow channels, flow resistances and sensing elements. The system may provide feedback signals that can be used to regulate fuel pressure accurately, resulting in a precisely controlled air-fuel mixing ratio. The terms "resistance" and "restriction" may be used herein interchangeably. The terms "inlet" and "outlet" may pertain to fluid devices. The term "port" may refer an inlet or an outlet. The terms "input" and "output" may pertain to electrical or fluid devices.

The present system does not necessarily need mechanical adjustment downstream of the pressure regulator. The system does not necessarily need an adjustable throttle, an adjustable orifice, or an adjustment for the mechanical or pneumatic pressure amplifier.

Still the present system may control an air-fuel mixing ratio for a wide range of applications, such as premix, air fuel proportional power jet, parallel positioning power jet, and the like.

The system may enable ways for air fuel mixing accuracy, fuel adaptability, air fuel proportional mixing, non-linear mixing curve, automatic commissioning, diagnostics, modulation range, fuel metering, fuel pressure surveillance, air pressure surveillance, revision control of settings, authorization control, safety and protection, and fail safe operation.

Precise control of the fuel-air ratio may be one of the most important aspects of improving overall burner performance and efficiency of a combustion chamber, such as a burner.

The description may show how a regulation approach measures a servo air mass flow, with a first mass flow sensor, that relates to a main air mass flow and how the regulation approach measures a servo air flow, with a second mass flow sensor, which relates to a main fuel flow.

The description may further show how the system is made fail safe by a first embedded approach to detect that mixture could go to an unsafe ratio due to sensor drift by detection and measuring the amount of sensor readings drift, and to correct for the measured amount of sensor drift in the first place or to shut off the application when the measured amount of drift passes a predefined threshold. Correction may be applied for changes in filter or orifice restriction.

The description may also show how the system is made fail safe by a second embedded approach that would detect that the mixing ratio could go to unsafe situation due to increased restriction of the fuel side filter and which will shut off the application when a certain predefined threshold is crossed.

The description may yet show how an installer can program virtually any curve that best fits the application, for mixing ratio of air mass flow and fuel mass flow as a function of burner capacity, and how the system can regulate the mixing ratio of air mass flow and fuel mass flow based on the commissioned and approved set points.

One item may be the related art regulation devices may have issues embedded which may be resolved. The issues may include difficult to access the adjustment devices, poor signal feedback to the installer, no possibility to fixate, lock or secure the tested and approved setting, needs manual adjustment, no automatic commissioning, no diagnostics, limited programmed mixing ratio possibility for different heat capacities, reliant at skills and patience of installer for safety and combustion quality, only valid for zero governor systems, a different solution is required for non-zero governor systems, and no or crude detection that settings have drifted off from the commissioned values.

The valve may be installed in all kinds of situations which means that reading the markings of the adjustment screw and adjusting the adjustment screw can be difficult in many cases. In a typical gas burner, it may be difficult to access, or to adjust. Thus, visual feedback of the adjustment device may be poor at location of burner.

Fixating or securing the adjustment device in a favored setting without disturbing the achieved setup may be very difficult or impossible, and time consuming.

Placing a cover to withdraw the adjustment screw from sight does not necessarily fixate the settings. It may be easy to touch the adjustment screw, and accidentally de-adjust the setting, while mounting the cover. Any cap or cover should be removable for the installer and can, unnoticed, be removed by some individual to change the setting of the boiler.

The related art systems may need manual adjustments. During commissioning the installer may attach a temporary combustion sensor to read combustion quality. Based on the measured result, the installer may need to turn screws according a defined procedure until combustion quality is good and acceptable. After each adjustment step, the combustion process and the burner may need to stabilize over time. The procedure may require patience, tools, time and skills by the installer. For air-gas proportional regulation systems, there may be two settings that can be adjusted by the adjustment screws.

Principally, a stepper motor may be applied to turn the adjustment devices for the installer. As soon as the power is off; however, the stepper may lose its position and need a reset of steps. An independent position feedback may need to validate that the adjustment devices are at a correct position. Thus, one or two actuators and one or two feedback systems may be needed just to maintain a static setting over time. These items may make it financially difficult to apply automatic commissioning.

During an operation of a system, a number of things may happen for which one may need sensing and diagnostics. For example, the building regulator may break resulting in high gas supply pressure; something may damage or block a gas supply line leading to an insufficient gas supply, and block an air supply leading to insufficient supply of air. Something may happen to a power supply leading to higher or lower fan speed than expected. Something may go wrong with air restriction valve. Something may block the chimney leading to changing air flow and causing higher combustion chamber pressure. A filter in a servo flow channel may get plugged by pollution. A sensor may drift from its setting. Chemical gas content may change over time. One of the orifices in one of the servo channels may get blocked. Someone may make a mistake during commissioning. Gas metering may go wrong. Different switches and/or sensors may be needed to detect an event about to happen. Zero governor systems or differential pressure sensors may have just limited use for applying diagnostics.

A programmed mixing ratio may be desired. Mixing a ratio of air and gas resulting from any zero governor system (where a flow sensor that regulates around zero flow is basically a zero governor as well) may be described as a first order function, such as $y=ax+b$, where y stands for fuel mass flow, x stands for air mass flow, a defines steepness of mixing ratio, defined by throttle screw, adjustable orifice, and b defines offset, defined by offset screw or flow through sensor.

A gas mass flow reading may be desired. Gas suppliers may change chemical content of gas over the year to improve demand for the winter and summer seasons, as many systems rely on pressure regulators. The gas content may be changed such that a Wobbe index (specific heat/density) remains constant, meaning that typical applications will not necessarily suffer from mis-adjustment because of changed content. A major drawback of flow sensors, even when the sensor is approved for use in natural gas, may be that the sensor measures flow by heat transfer, meaning that the reading relies on all kinds of specific gas parameters like density, viscosity, specific heat, and a specific heat conduction coefficient. When the chemical content of the gas used changes over time, a reading error may occur in the mass flow sensor. For this reason, a flow sensor cannot necessarily be applied to accurately measure gaseous flows with changing chemical content over time.

Drift detection may be desired. In some systems, pressure switches may be used to shut the application off when a certain pressure target is not met. When the application runs at a relative low power level, it may be difficult to distinguish between acceptable and non-acceptable drift.

The present system may involve a (1) regulation system, a (2) regulation approach, and a (3) regulation product that solves known issues and offers a solution for gas burner application systems (e.g., air-gas proportional premix, air-gas proportional forced draft, and/or parallel positioning forced draft).

The present control system may eliminate weaknesses regarding mechanical adjustment devices and flow measuring with a flow sensor of gaseous fluids. The control system may exclude mechanical adjustment needs. Also, the system may combine the measurement of fuel and air in such a way that a second flow sensor can be used to measure both fluids with respect to each other while just air flows through the first and second sensors.

FIG. 1 is a diagram of a measurement system 15 that may provide signals for fuel regulation. An example fuel may be natural gas for illustrative examples discussed herein but other kinds of fuel may be applicable to the present system and approach. The system may consist of two servo mass flow inlets. One inlet 17 may be connected to a reference air flow duct with a reference air pressure. Another inlet 16 may be connected to a gas flow duct with a regulated pressure.

The system may consist of one outlet 18 which is connected to a reference point downstream of the inlet points in the boiler where air and gas has been mixed together, for instance, at a combustion chamber or downstream of a mixing device. The system may also consist of three or so filters 19, 20, 30 to filter particles out of the incoming air, out of incoming gas and outgoing air-gas that might flow back due to a pressure surge during ignition. The system may consist of four or so flow resistances 21, 22, 23, 24, typically orifices. The flow resistances may be different from each other in size and resistance level. The system may incorporate two mass flow sensors 25, 26, of which produce flow dependent (electrical) signals.

Pressure in a fuel channel is not necessarily measured. Mass flow through the sensors may be measured; or in case that a sensor is calibrated for differential pressure, a pressure drop over the sensor may be measured. From there, an indication for pressure in the fuel channel may be calculated. The calculated pressure is not necessarily an exact value.

The system may incorporate a first servo flow channel 141 from positive air reference pressure (A) 27 to a lower pressure (C) 28 combustion chamber. The first servo channel may incorporate an inlet filter (E) 20, a mass flow sensor (H) 25, a mass flow resistance (I) 23 and a back-flow outlet filter (G) 30. The mass flow sensor (H) 25 may produce a first electrical signal (#1) 31 which reflects the servo mass flow of air through the first mass flow channel. The system may incorporate a second servo flow channel 142 from positive air reference (A) pressure to an intermediate pressure connection point (D). The second servo channel may incorporate the inlet filter (E) 20, a mass flow sensor (J) 26 and a mass flow resistance (K) 24. The mass flow sensor 26 may produce a second electrical signal (#2) 32 which reflects the servo mass flow of air through the second mass flow channel.

The system may incorporate a third servo flow channel 143 from positive regulated gas pressure (B) 34 to an intermediate pressure connection point (D) 33. The third servo channel may incorporate an inlet filter (F) 19, a check valve (L) 35 and one or more mass flow resistances in parallel (M) 21. The check valve 35 may be open to allow gas to flow from the inlet 16 of regulated gas (B) 34 pick-up to the intermediate pressure point (D) 33, or from the intermediate pressure point (D) 33 to the regulated gas pressure (B) 34 pick-up point. The check valve (L) 35 may be closed (shut of) to prevent gas to flow from or to the intermediate pressure point (D) 33 to the regulated gas pressure pick up point (as flow is still allowed to flow from intermediate pressure point to combustion chamber when the valve is closed).

The system may incorporate a fourth servo flow channel 144 from the intermediate connection point (D) 33 to the lower pressure combustion chamber (C) 28. The fourth servo channel may incorporate a flow resistance (N) 22 and an air filter (G) 30. The filters for multiple channels may be combined into one combination filter.

Figure 1A:
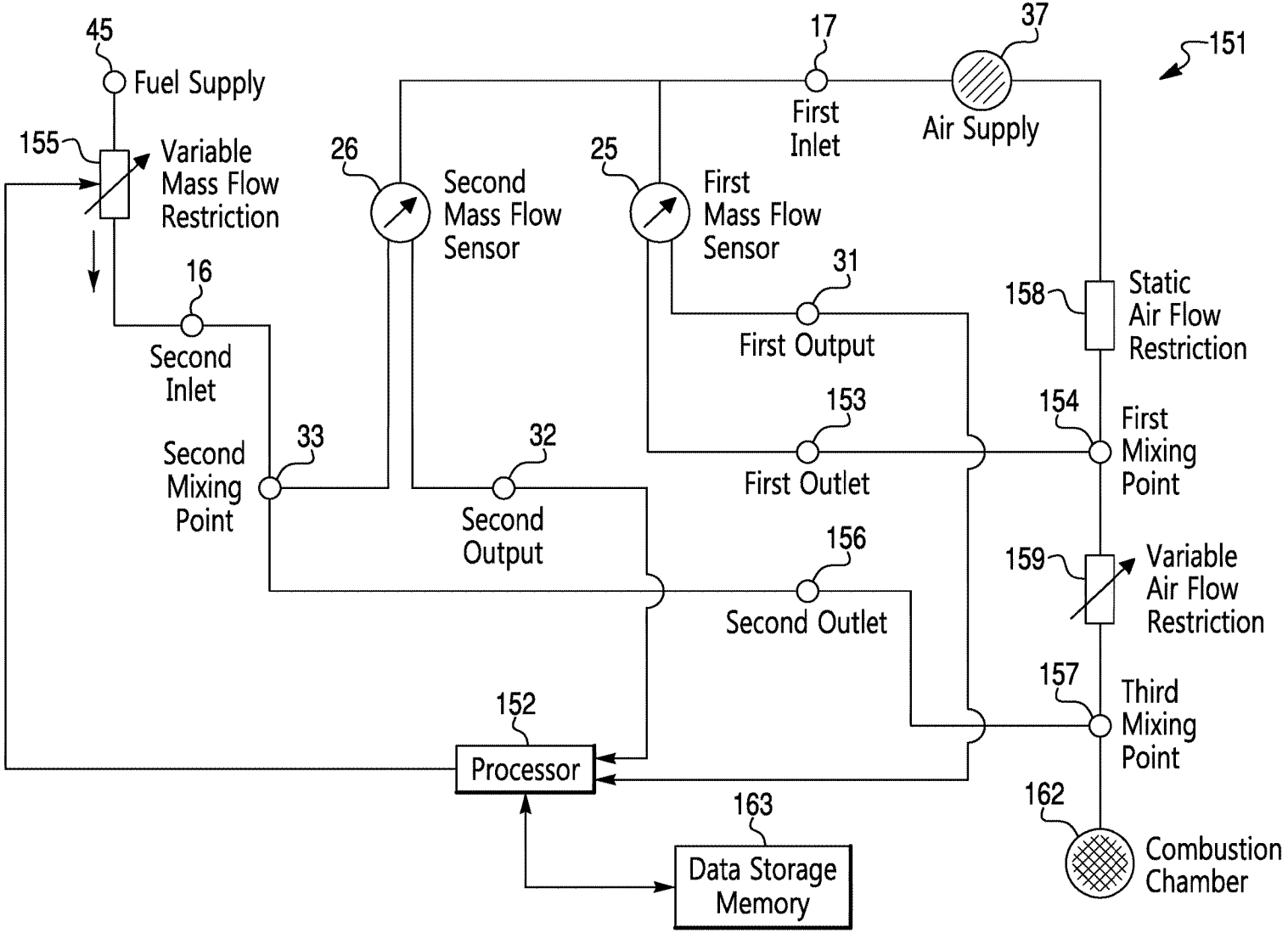
FIG. 1*a* is a diagram of a burner control system having three mixing points.

FIG. 1*a* is a diagram of a burner control system 151 which may be a variant of system 15 in FIG. 1. Air supply 37 may provide air to a first inlet 17 which has a connection with inlets of first mass flow sensor 25 and second mass flow sensor 26. A first signal output 31 from flow sensor 25 may be connected to an input of a processor 152, and a second signal output 32 from flow sensor 26 may be connected to another input of processor 152. An outlet of flow sensor 25 may be connected to a first outlet 153 of system 151. Outlet 153 may be connected to a first mixing point 154. An outlet of flow sensor 26 may be connected to a second mixing point 33.

A fuel supply 45 may be connected to a variable mass flow restriction 155. A downstream end of restriction 155 may be connected to a second inlet 16 of system 151. An output of processor 152 may provide a signal to adjust or vary restriction 155.

Inlet 16 may be connected to mixing point 33. Mixing point 33 may be connected downstream to a second outlet 156 of system 151. Outlet 156 may be connected to a third mixing point 157.

Air supply 37 may be connected to a static air flow restriction 158. Restriction 158 may be connected downstream to first mixing point 154. Mixing point 154 may be connected downstream to a variable air flow restriction 159 which in turn can be connected to third mixing point 157. Mixing point 157 may be connected downstream to a combustion chamber 162. A data storage memory 163 may be connected to processor 152.

Figure 1B:
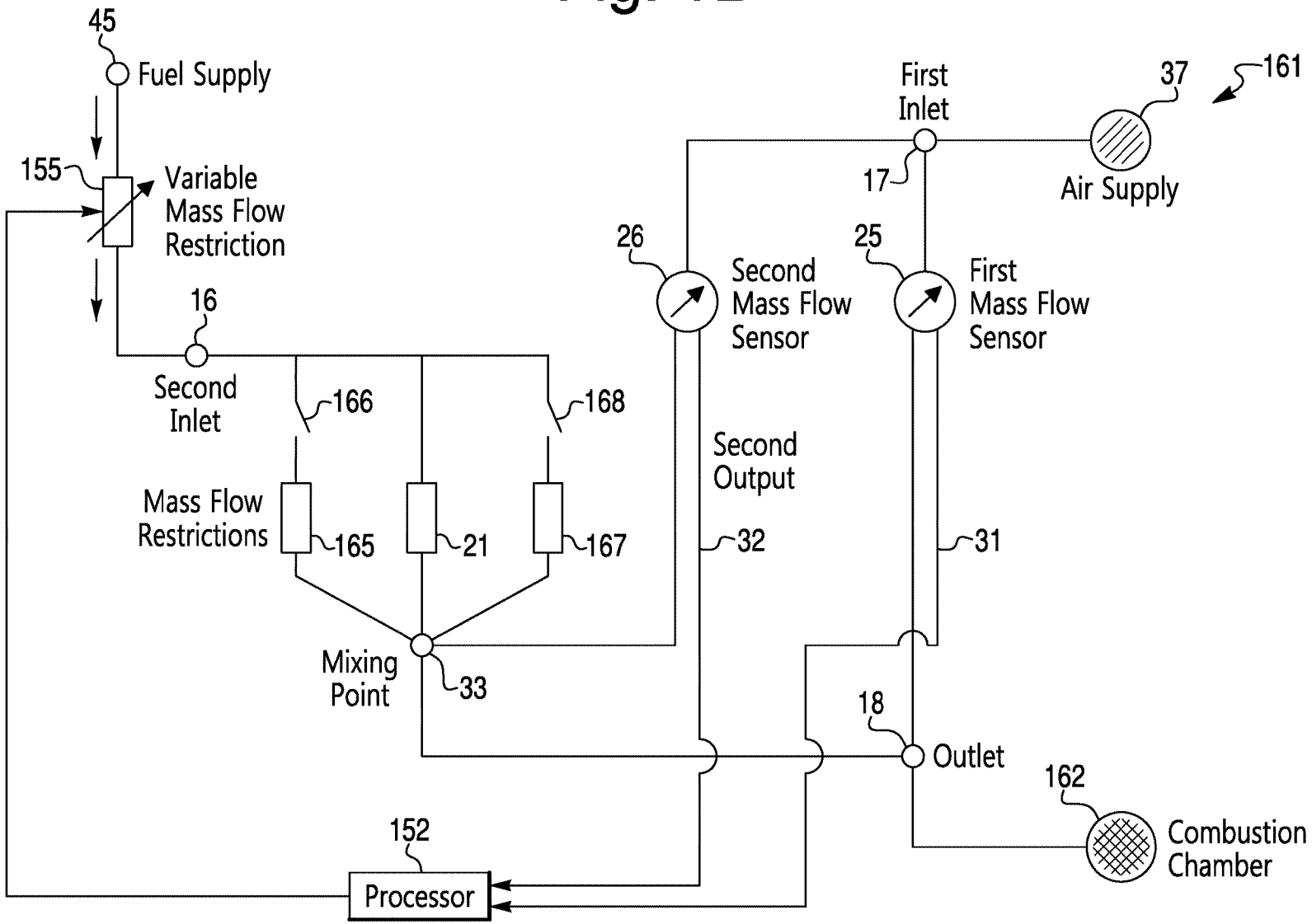
FIG. 1*b* is a diagram of a burner control system having selectable mass flow restrictions relative to fuel flow to a mixing point.

FIG. 1*b* is a diagram of a burner control system 161 which may be a variant of system 15 in FIG. 1. Air supply 37 may provide air to a first inlet 17 which has a connection to inlets of first mass flow sensor 25 and second flow sensor 26. A first signal output 31 from flow sensor 25 may be connected to an input of a processor 152, and a second signal output 32 from flow sensor 26 may be connected to another input of processor 152. An outlet of flow sensor 25 may be connected to an outlet 18 of system 161. Outlet 18 may be connected to a combustion chamber 162. An outlet of flow sensor 26 may be connected to a mixing point 33.

A fuel supply 45 may be connected to a variable mass flow restriction 155. A downstream end of restriction 155 may be connected to a second inlet 16 of system 161. An output of processor 152 may be provided to variable mass flow restriction 155.

Inlet 16 may be connected downstream to a mass flow restriction 21. Restriction 21 may be connected downstream to mixing point 33. One or more additional restrictions may be connected in parallel with restriction 21. For example, a restriction 165 may have an inlet connected to a valve 166 that is connected to inlet 16. An outlet end of restriction 165 may be connected to mixing point 33. If needed or desired, another restriction 167 may have an inlet connected to a valve 168 that is connected to inlet 16. An outlet of restriction 167 may be connected to mixing point 33. Values 166 and 168 may open or close to switch in or out, respectively, restrictions 165 and 167.

Figure 2:
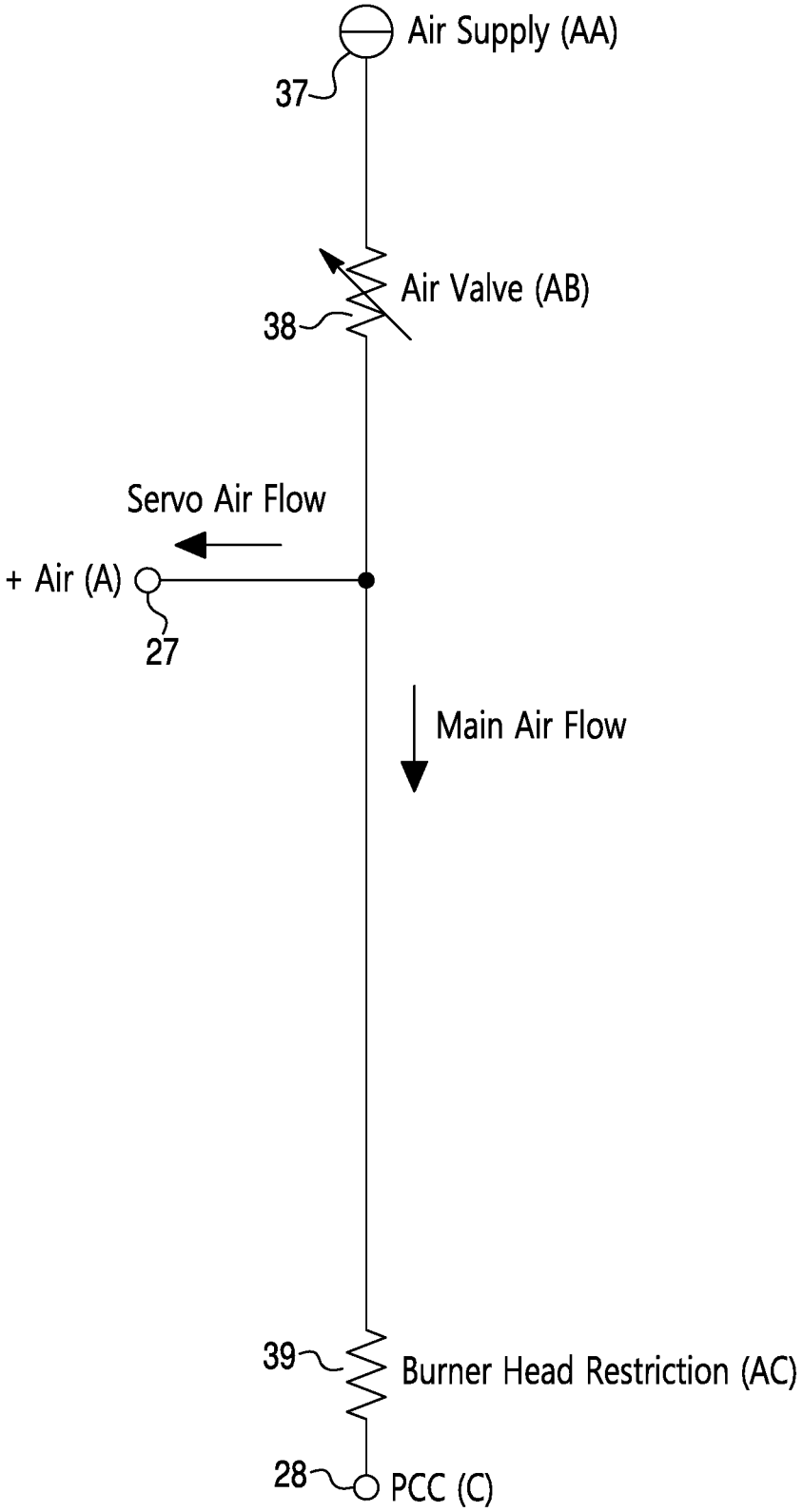
FIG. 2 is a diagram of a representation of a reference air flow.

FIG. 2 is a diagram of a representation of a reference air flow. In a main air flow channel, a pressure difference may be created by an actuator like a fan or a pump at an air supply inlet (AA) 37. A fan or pump may result in the fact that a relative high pressure occurs upstream, at the inlet (AA) 37 in comparison with a relative low pressure downstream, at the outlet (C) 28. The actuator may be placed near the inlet, but also at other positions in the air channel. In order to adjust the reference air (mass) flow, it may be possible to change the speed of the actuator or possible to operate an adjustable air flow restriction, like an air valve (AB) 38. The air valve (AB) 38 is not necessarily mandatory in the air channel.

Upstream of a combustion chamber (C) 28, a burner head may be positioned to represent a flow restriction (AC) 39. Burner head flow restriction (AC) 39 may be an important feature for the regulation as it can produce a pressure difference between reference point (A) 27 and reference point (C) 28 as a function of the main air flow through the burner head restriction 39 that is used to feed the sensing module 15. Instead of burner head resistance also a dedicated static flow resistance may be used to generate a reference pressure difference. This dedicated resistance may be applied in case that the burner head may be varied for some reason like variation over time or variation over flow capacity.

Figure 3:
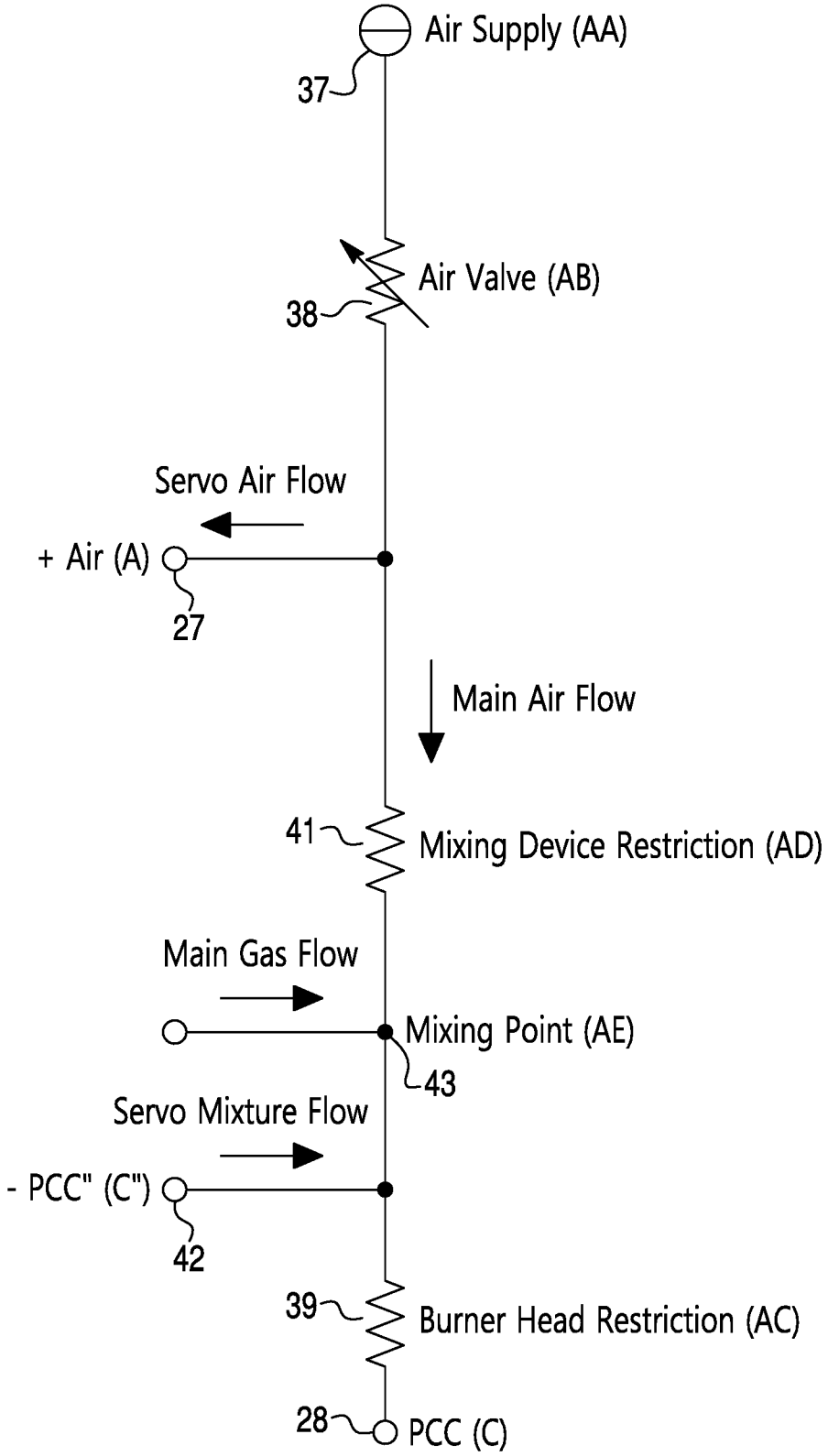
FIG. 3 is a diagram of a representation of a reference air flow for a premix

FIG. 3 is a diagram of a representation of a reference air flow for a premix application. For premix applications where air and gas is mixed before the burner head, it may be possible to make use of the flow resistance of the air side section of the mixing device (for instance, the inlet of a venturi. In case of a premix, a mixing device flow restriction (AD) 41 may be an important feature for the regulation as it can create a pressure difference between reference point (A) 27 and reference point (C") 42 as function of the main air flow over the mixing device restriction 41 and the mixing point (AE) 43 that is used to feed the sensing module 15.

Figure 4:
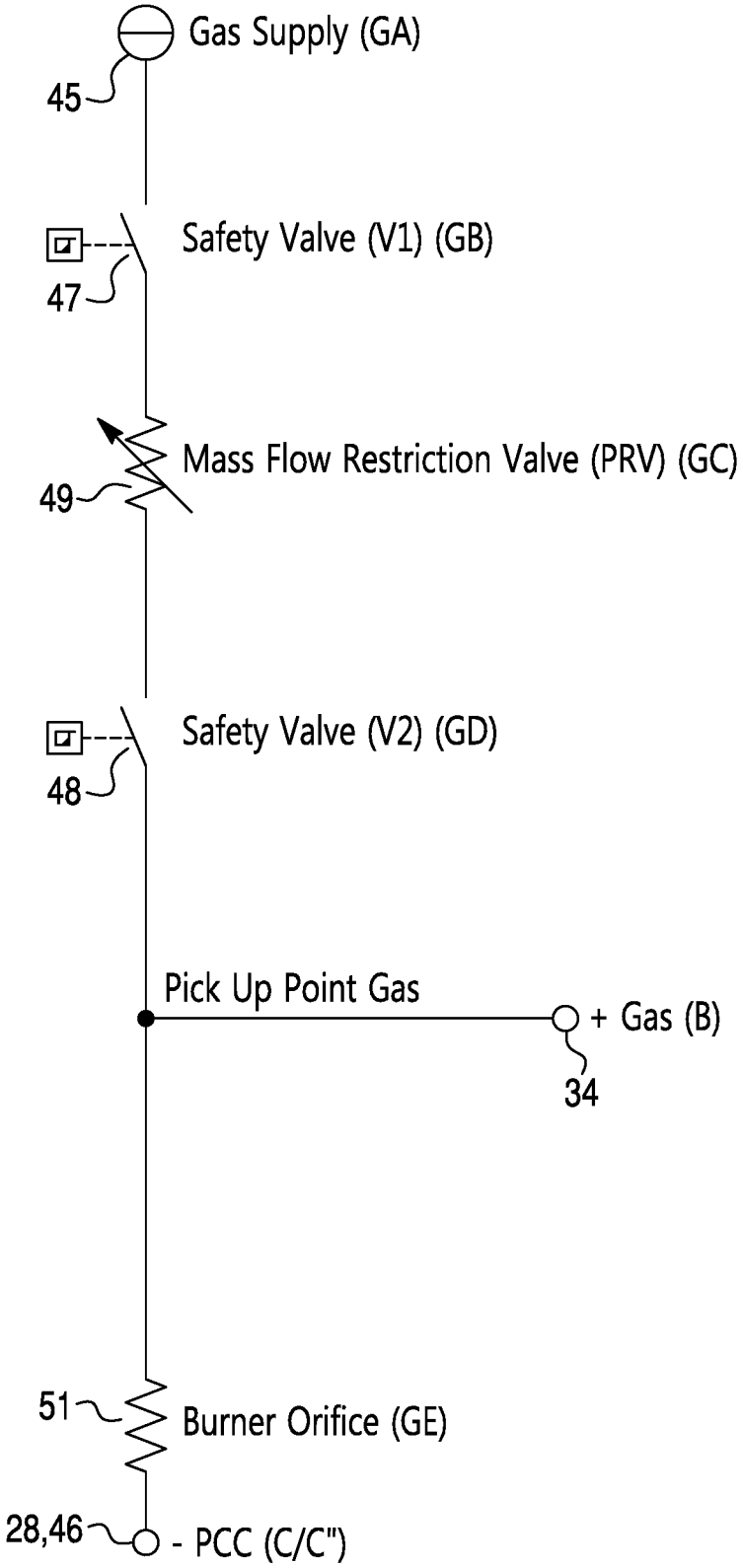
FIG. 4 is a diagram of a representation of a regulated gas flow.

FIG. 4 is a diagram of a representation of a regulated gas flow. In the main gas flow channel, an inlet pressure may be supplied (GA) 45 which is higher than the combustion chamber pressure (C/C") to the system. In the gas channel, a first safety shut off valve (GB) 47 may be present for safety reasons. A second safety shut off valve (GD) 48 may be present for safety reasons. The safety shut off valve may be either opened or closed. An adjustable flow restriction valve (GC) 49 may be available to regulate the gas flow to a desired level between a minimal and maximal value. The adjustable flow restriction valve 49 may be at any position between maximal closed and maximal open. The mass flow restriction valve (GC) 49 may be positioned between the first safety shut off valve (GB) 47 and the second safety shut off valve (GD) 48, but it may also be possible to position the restriction valve (GC) 49 upstream of the first safety shut off valve (GB) 47 and downstream of the second safety shut off valve (GD) 48 though upstream of the pressure pick-up point (B) 34 for gas pressure.

Downstream of gas pick-up point (B) 34 and upstream of combustion chamber pressure (C) 28 or mixing device pressure (C") 42 (FIG. 3), a flow restriction like a burner orifice (GE) 51 (FIG. 4) may be present which generates a pressure difference as a function of gas flow that is used to feed the sensing module 15 between points (B) 34 and (C) 28 (FIG. 1). A pressure after burner office 51 may be combustion chamber PCC(C) 28 or PPC(C") 46 (FIG. 4).

It may be desirable to regulate gas mass flow in relation to an air reference mass flow such that gas and air are mixed together, in the combustion chamber or in the mixing device chamber or likewise, according a pre-defined ratio. The predefined mixing ratio may relate to the production of combustion emission gases like CO2, CO, and NOx. The optimal mixing ratio may differ slightly from application to application. Also, the optimal mixing ratio may differ slightly over the heat capacity band of a given application, meaning that a burner might need a different mixing ratio at low capacity conditions than at medium capacity conditions or than at maximum capacity conditions. Additionally, it may be that a startup condition needs a different mixing ratio than a burning operation condition. In all, the mixing ratio may need to be flexible to cover different conditions and be repeatable in its setting to obtain a comparable combustion result, time and time again.

Setup and commissioning may be noted. In order to set up, use and check the system for proper combustion, a number of different operating conditions may be considered for the regulation system.

Figure 5:
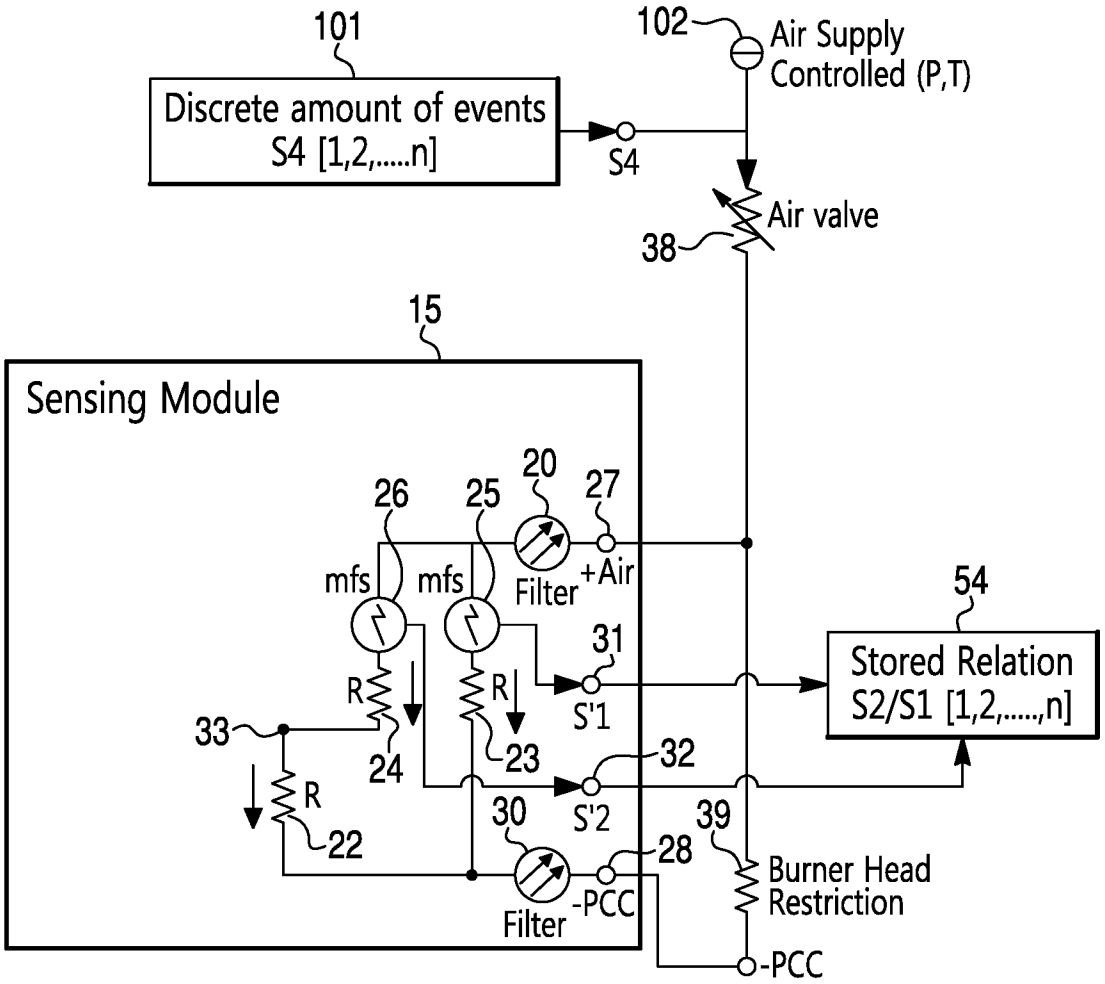
FIG. 5 is a diagram of a first operating condition for a regulation system.

FIG. 5 is a diagram of a first operating condition for a regulation system. In the first operating condition for the regulation system where the check valve 35 in the sensing module 15 is closed and where the gas flow channel is separated from the sensing module, and hence does not necessarily affect the sensor readings 31 and 32, a discrete number of different air flow levels may be generated through the main air flow tube (right side) which can cause a discrete number of different pressure differences over the burner head restriction that leads to a discrete number of servo flows through the first, the second and the fourth servo channels of the sensing module 15 and that will produce a discrete number of sensor readings for mass sensor (#1) 25 and for mass sensor (#2) 26. The air supply pressure and air supply temperature are not necessarily conditioned, but may be least controlled in that they represent a condition that matches the situation when the sensor readings were stored. The first servo channel which contains mass flow sensor (#1) 25 may be, in this situation, in parallel with the second channel and fourth servo channel which contain mass flow sensor (#2) 26. The two parallel channels may be fed by the same source and the mass flows may be released to the same sink. Also, the mass flows may pass the same inlet filter 20 and exit filter 30, and the flow resistances 22, 23, 24, as the mass flow sensors 25, 26 may be static non-variable components meaning that the ratio of sensor (#2) 26 reading and sensor (#1) 25 reading should be consistent and repeatable. The sensor readings as signals 31 and 32 for sensor (#1) 25 and sensor (#2) 26, respectively, may be stored as reference values at storage 54, indicated as S'1[1, 2, . . . , n] and S'2[1, 2, . . . , n].

Corresponding to the readings at storage 54 may be a discrete amount of events S4[1, 2, . . . , n] at symbol 101 with a connection between a controlled air supply 102 and an air valve 38 which may be controlled. During setup the installer is somehow able to control the air supply, by air supply or air valve, but under an operation mode the air flow may be controlled by an external device and not be accessible for our regulation system. Still the relation is there, but one does not necessarily control the source.

Figure 6:
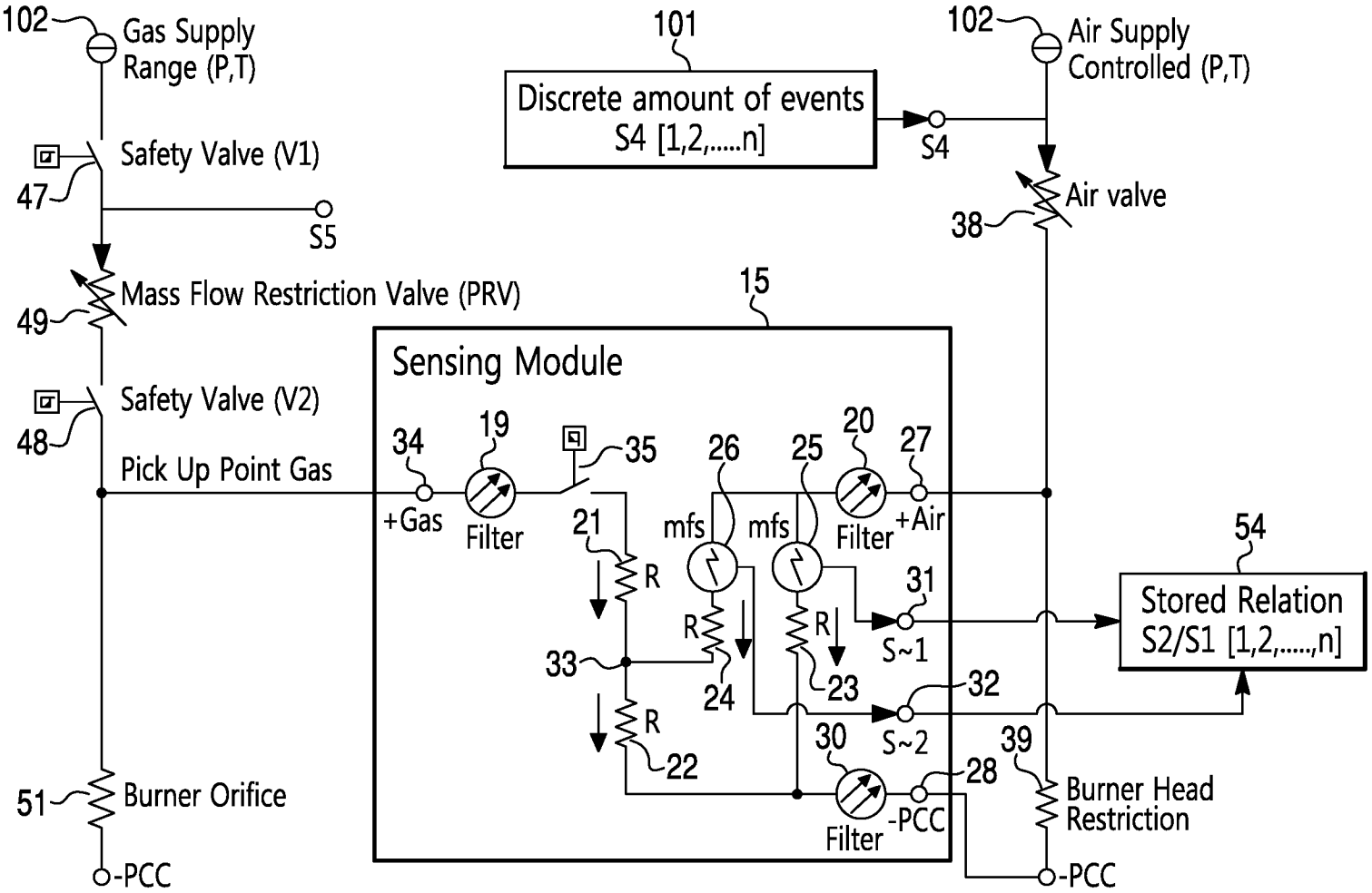
FIG. 6 is a diagram of a second operating condition for the regulation system.

FIG. 6 is a diagram of a second operating condition for the regulation system. In the second operating condition for a regulation system, where the check valve 35 in the sensing module 15 is opened, at least one of the two safety shut off valves 47 and 48 may be closed, and the gas flow channel be transformed (regarded as) into another air flow channel from the sensing module 15 to the combustion chamber or the mixing device chamber, again a discrete number of different air flow levels may be generated through the main air flow tube (right side) which can cause a discrete number of different pressure differences over the burner head restriction 39 which will lead to a discrete number of servo flows through the first, the second, the third and the fourth servo channels of the sensing module 15 and which may produce a discrete number of sensor readings for mass sensor (#1) 25 and for mass sensor (#2) 26. The air supply pressure and air supply temperature are not necessarily conditioned, but are at least controlled in that they represent a condition that matches the situation when the sensor readings are stored. The first servo channel which contains mass flow sensor (#1) 25 may in this situation be in parallel with the second, third and fourth servo channels which contain mass flow sensor (#2) 26.

The two parallel channels may be fed by the same source and the mass flows may be released to the same sink. Also, the mass flows may pass the same inlet filter, but the gas inlet filter in this case may function as a second exit filter and the flow resistances as well as the mass flow sensors may all be static non-variable components meaning that the ratio of sensor (#2) 26 reading 32 and sensor (#1) 25 reading 31 should be consistent and repeatable (the servo air flow crosses also the burner orifice resistance, this burner orifice is ignored for this operation condition, as the cross sectional area of the orifice is dimensioned for the main gas flow and in fact can be regarded infinitely large for the servo air flow which is much smaller than the main flow). The sensor readings for sensor (#1) 25 and sensor (#2) 26 may be stored as reference values at storage 54, indicated as S~1[1, 2, . . . , n] and S~2[1, 2, . . . , n] (or any other indication).

Corresponding to the readings at storage 54 may be a discrete amount of events S4[1, 2, . . . , n] at symbol 101 with a connection between a controlled air supply 102 and an air valve 38 which may be controlled.

FIG. 7 is a diagram of a third operating condition for the regulation system. A combustion sensor (mixing ratio) 56 may provide a measured combustion result at symbol 103. A target combustion result may be provided at symbol 104. The difference between the measured and target combustion results may be determined as an error at symbol 105. The measured combustion result may be changed with an adjustment of a gas flow from gas supply 102 as indicated at symbol 106 to reduce or eliminate the error or difference between the measured and target combustion results.

In the third operating condition for a regulation system, where the check valve 35 in the sensing module 15 is opened, all safety shut off valves 47 and 48 may be opened. Sensor (#1) 25 may measure air mass flow parallel to the main air flow and the measured flow may have a direct relation to the main air mass flow. Sensor (#2) 26 may measure air mass flow between the air reference point 27 and the intermediate pressure point 33 between channels three and four. As a result of gas mass flow, a pressure difference over the burner orifice 51 may result which forms a second pressure difference over the sensing module 15. As a result of the direction of the main gas flow and the matching pressure difference over the burner orifice 51, the gas inlet pressure 34 over the sensing module 15 at the entrance of servo channel three may be higher than the exit pressure downstream of channel four and channel one. The flow resistances in servo channel three and servo channel four may be chosen such that the intermediate pressure is somewhere between the gas inlet pressure 34 and the mixture outlet pressure 28, and lower than the corresponding reference air inlet pressure 27.

For each discrete number of combinations of air mass flow and gas mass flow, a unique and discrete number of matching combinations of sensor (#1) 25 reading 31 and sensor (#2) 26 reading 32 may be captured. Sensor readings 31 and 32 for sensor (#1) 25 and sensor (#2) 26 may be stored as reference values to a commissioned number of valid and approved settings for the application at storage 54, indicated as S1[1, 2, . . . , n] and S2[1, 2, . . . , n];

where the gas mass flow for each discrete air mass flow is regulated, by adjusting a gas mass flow restriction valve 49, to a level that gives acceptable readings of the combustion sensor 56 which is temporarily installed and processed.

Corresponding to the readings at storage 54 may be a discrete amount of events S4[1, 2, . . . , n] at symbol 101 with a connection between a controlled air supply 102 and an air valve 38 which may be controlled, and S3[1, 2, . . . , n] at 103 with a connection between mixing ratio of a controlled air supply and a controlled gas supply.

Transfer functions may be noted. The transfer functions may be generated out of a discrete number of stored sensor readings for sensor (#1) 25 and sensor (#2) 26, for the above mentioned operating conditions, which should cover a continuous range between the minimal values and the maximal values.

A first transfer function S'2=F1(S'1) may describe a curve that represents sensor readings for the situation in which the check valve 35 is closed, and where it makes no difference if the safety valves 47 and 48 are opened or closed.

A second transfer function S~2-S'2=F2(S~1,S'1) may describe a curve that shows the difference between the check valve 35 closed and check valve 35 opened during a pre-purge situation. Pre-purge may mean that a rather large air flow is blown through the boiler application, while the safety shut off valves 47 and 48 are closed, to clean the application from any unburned gaseous content. The function may describe a reference situation for a clean filter and an open orifice in servo channel three (gas servo channel).

A third transfer function S2=F3(S1) may describe a curve that shows a sensor reading that reflects a curve through commissioned and approved mixing ratio of gas mass flow and air mass flow between the minimum capacity and maximum capacity for which appropriate combustion results have been validated and approved during the commissioning process.

A run mode (run mode=a sixth operation condition) may be noted. After the above mentioned sensor readings 31 and 32 have been measured and stored, and the transfer functions have been established in the software, the application may be ready to run unattended without an installer or combustion result sensor 56 (FIG. 7) by repeating the former approved situation. During a run mode, the air mass flow may result from a fan/blower speed and or a position of the air valve 38 which fed by some continuous, for the present regulation system, signal. Also, the air supply pressure and the gas supply temperature, as well as the air supply moisture content, might not be the same as the reference values during the commissioning but instead they might be any value within a certain range.

During run mode a combustion sensor (mixing ratio) 56 may provide a measured combustion result at symbol 103. A target combustion result may be provided at symbol 104. The difference between the measured and target combustion results may be determined as an error at symbol 105. Transfer function F3 may be corrected based on the established error between measured combustion results and target values in order to adapt for changed chemical gas content or the like to reduce or eliminate the error or difference between the measured and target combustion results in a continuous and automatic way.

Figure 8:
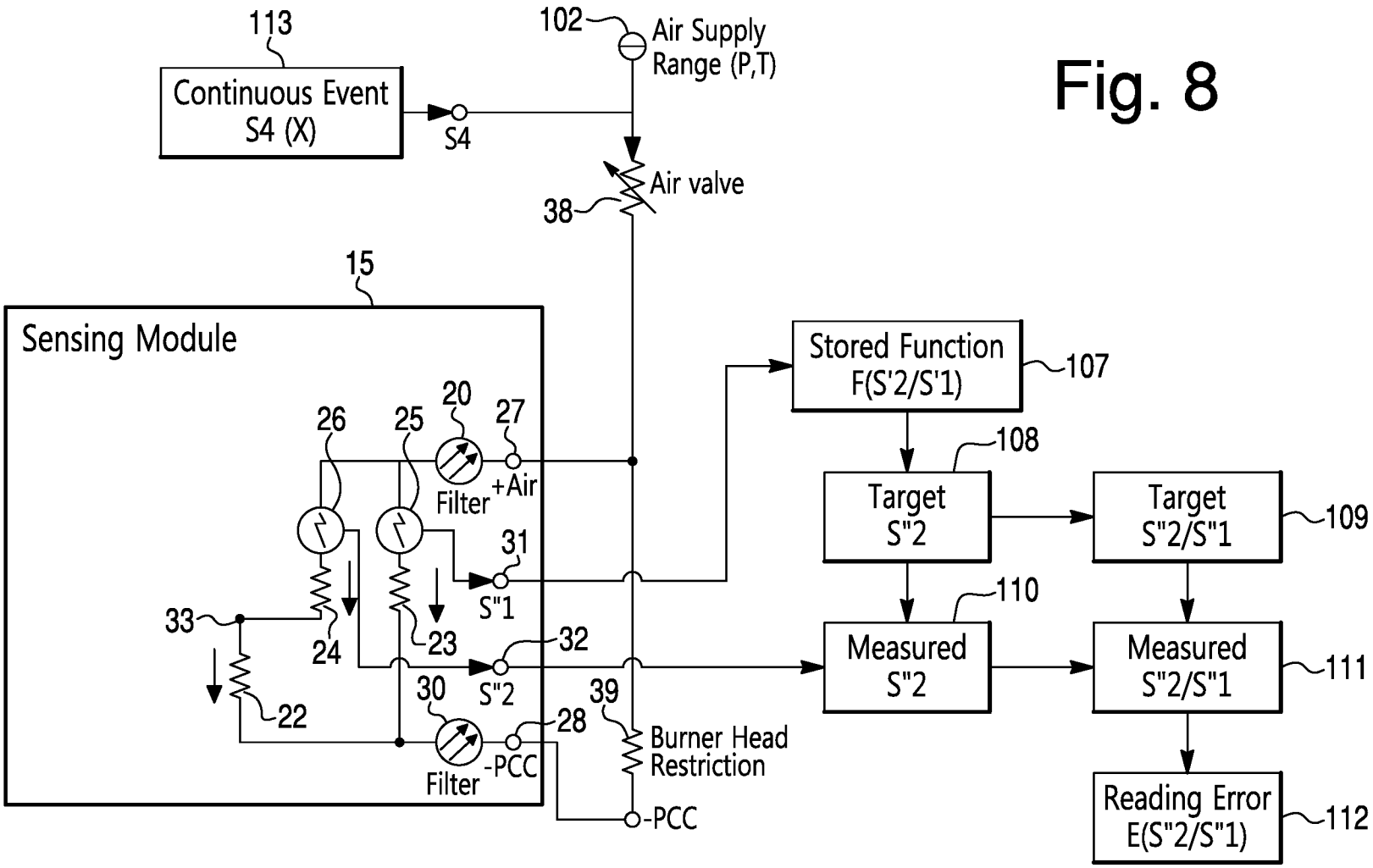
FIG. 8 is a diagram of a fourth operating condition for the regulation system.

FIG. 8 is a diagram of a fourth operating condition for the regulation system. In the fourth operating condition, an unknown air mass flow may be generated through the main air flow channel, the check valve 35 may be closed, and the safety shut off valves 47 and 48 might be open or closed. An unknown air mass flow may cross the burner head restriction 39 and a pressure difference will occur over that burner head resistance where the upstream pressure is higher than the downstream pressure. The pressure difference over the burner head restriction 39 may feed two servo flows in two separate servo channels in the sensing module 15. Each servo channel may contain mass flow sensors 25 and 26, respectively, which will generate a reading signal based on the servo mass flow through the sensor.

A reading of sensor (#1) 25 may be multiplied with the first transfer function that was derived from the first operating condition to calculate a target reading for sensor (#2) 26, and a target relationship between sensor (#2) 26 reading 32 and sensor (#1) 25 reading 31 may be established. An actual reading 32 of sensor (#2) 26 might be different than the established target reading and also the measured relationship between sensor (#2) 26 and sensor (#1) 25 might be different than the target relationship.

Two different servo channels with virtually all static components that are fed by the same upstream pressure and which release to the same downstream pressure should maintain the same relationship between the servo mass flows. A measured difference between the measured relationship and the target relationship may indicate that the sensor readings have shifted. The shift may have occurred due to different reasons like different temperature, different moisture content, different pressure level, aging and so on.

The amount of error between the target relationship and the measured relationship may be used to determine a correction factor for sensor reading drift. For example, one may assume that the sensor (#1) 25 reading 31 is 1.20 mg air/sec. and the stored transfer function S'2=F1(S'1). The transfer function F1 may be a curve, but for a simplified example the transfer function may also be regarded as a constant=>S'2=0.75*S'1. A target reading 32 for sensor (#2) 26 may be calculated as 1.20*0.75=0.90 mg/sec.

One may assume that the measured reading 32 of sensor (#2) 26 would be 0.93 mg/sec for some reason. It may be noted that the sensor relationship has drifted from 100% to 0.93/0.90*100%=103.3% of the original relationship. A first correction factor for the drifted relationship may be an inverse of the established drift, 100/103.3=96.8%. A first threshold may be defined as a decision parameter if the correction is acceptable or that the installation needs to be re-commissioned.

Figure 9:
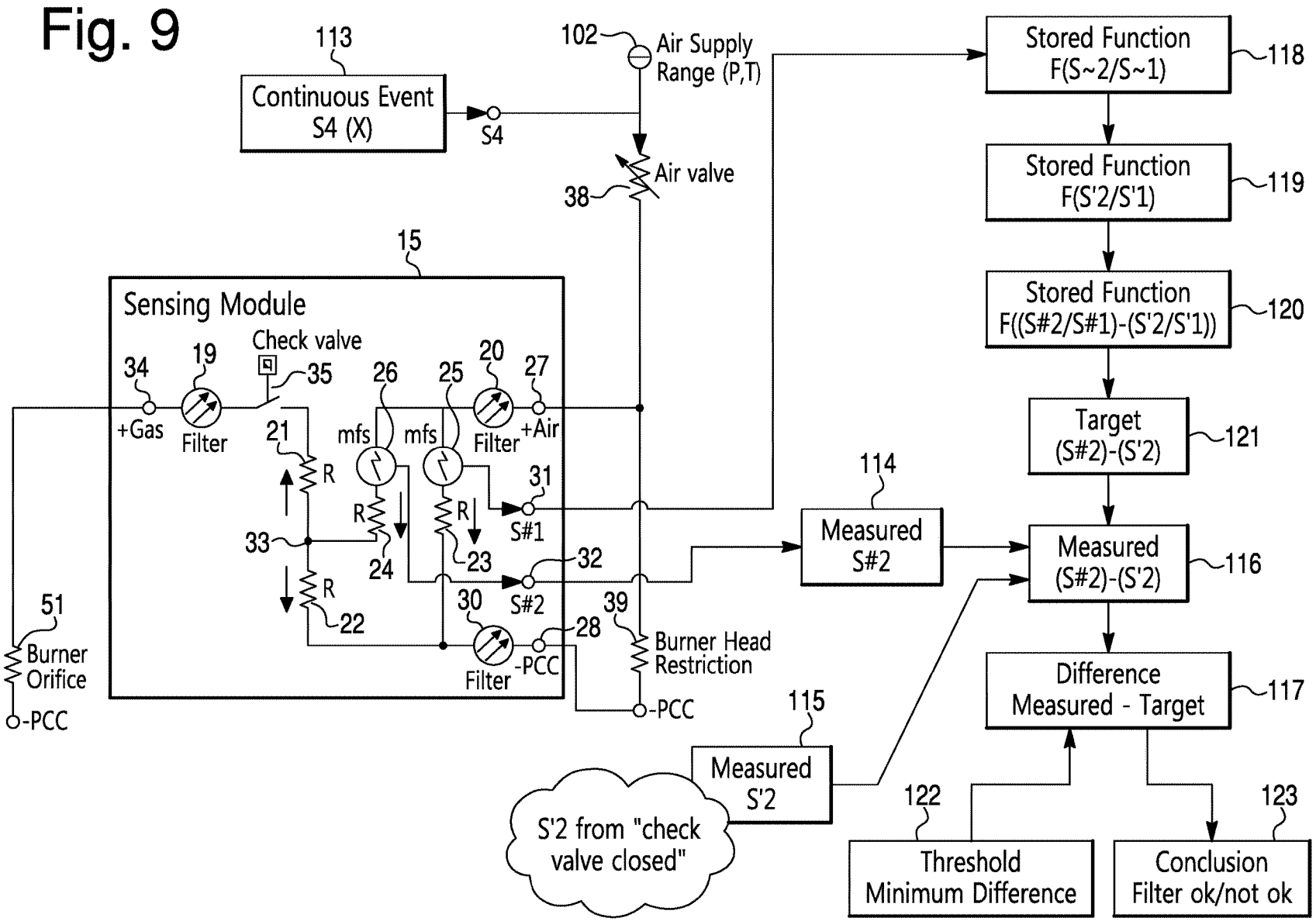
FIG. 9 is a diagram of a fifth operating condition for the regulation system.

FIG. 9 is a diagram of a fifth operating condition for the regulation system. The fifth operating condition may occur during a pre-purge situation where an unknown air mass flow is generated through the main air channel, and where the check valve 35 is opened, but where at least one of the safety shut off gas valves 47 and 48 is closed. As the check valve changes state (open/close) during pre-purge, the fourth operating condition may occur nearly at the same time as the fifth operating condition for which applies that the air supply conditions are unknown but at least almost equal for the two operating conditions (fourth and fifth). The unknown air mass flow may cross the burner head restriction 39 and a pressure difference will occur over the burner head restriction where the upstream pressure is higher than the downstream pressure. The pressure difference over the burner head restriction 39 may feed two servo flows in two separate servo channels in the sensing module. Each servo channel may contain a mass flow sensor which will generate a reading signal based on the servo mass flow through the sensor.

A new transfer function may be calculated out of the transfer function for the first and the second operating conditions, which calculates the target difference in sensor (#2) 26 reading 32 for the two operating conditions as a function of sensor (#1) reading 25. A sensor (#2) 26 reading 32 for the fifth operating condition may be measured. A sensor (#2) 26 reading 32 for the fourth operating condition may be measured just before and stored for comparison (or vice versa). A difference of the measured sensor (#2) 26 readings 32 for both operations may be calculated and compared with the target difference.

If the measured difference is smaller than the target difference, then the inlet gas filter 19 or the orifice in the servo gas channel may suffer pollution. As the difference of readings for two situations are compared, the absolute error of the sensors do not necessarily affect the accuracy of the measurement, even a small difference counts many sensor (resolution) steps and change will be detected.

As an example, sensor (#1) 25 reading may be assumed to be 1.20 mg air/sec. The first stored transfer function may be assumed as S'2=0.75*S'1. The second stored transfer function may be assumed as S~2=0.80*S~1. A target difference for the readings of sensor #S may be calculated as 1.20*(0.80−0.75)=0.06 mg/sec.

A measured reading of sensor (#2) 26 with closed check valve 35 may be assumed as 0.93 mg/sec and it may be known that a first correction factor of 96.8% should be applied, to correct the reading to 0.90 mg/sec.

A measured reading of sensor (#2) 26 with an opened check valve 35 may be assumed as 0.97 mg/sec and a first correction factor of 96.8% should be applied to correct the reading to 0.938 mg/sec. A measured difference, which may be corrected for a drift, of the readings of sensor #S may be calculated as 0.938−0.90=0.038 mg/sec.

In the example, the measured difference of 0.038 mg/sec may only be 63% of the target value which indicates that the difference between check valve 35 open and check valve 35 closed has decreased and that the filter 19 or the orifice may suffer from serious pollution. A second threshold may be defined as a decision parameter if the situation is still acceptable or not.

It may be possible to apply a correction for a plugged filter or orifice.

A measured difference from a symbol 116 may be compared with a target difference at a symbol 117 and be difference of the measured and target differences. A threshold minimum difference from symbol 122 may be compared with the difference at symbol 117. If the threshold difference is not exceeded or is exceeded, then a conclusion may be that filter 19 is ok or not ok, respectively, as indicated at symbol 123.

Figure 10:
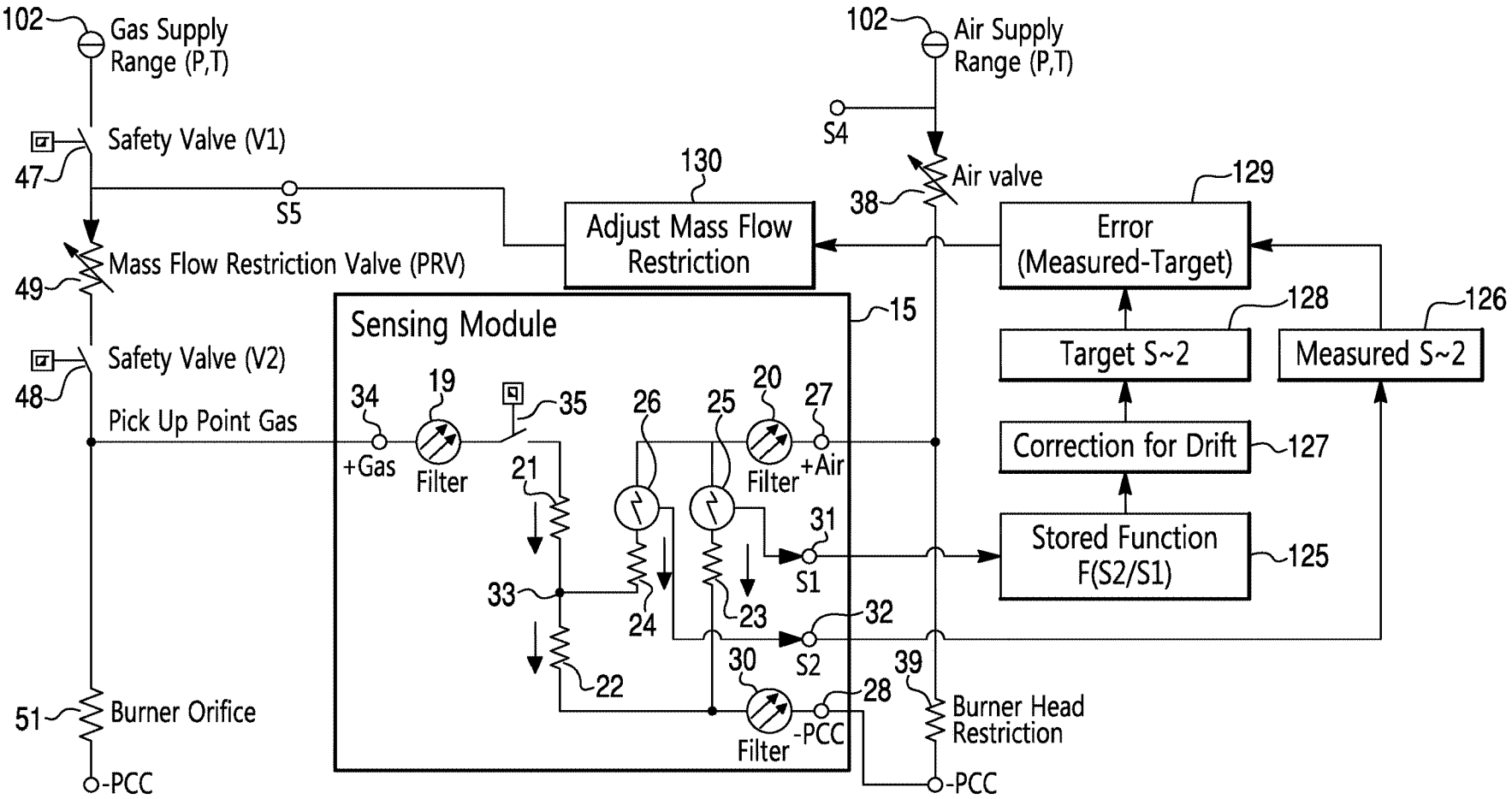
FIG. 10 is a diagram of a sixth operating condition for the regulation system.

FIG. 10 is a diagram of a sixth operating condition for the regulation system. In the sixth operating condition, an unknown air mass flow may be generated through the main air flow channel. The unknown air mass flow may cross the burner head restriction 39 and a pressure difference may occur over that burner head resistance where the upstream pressure is higher than the downstream pressure.

During the sixth operating condition, check valve open, all safety shut off valves open, a gas restriction valve 49 may be at a certain position which is defined by a regulation algorithm, such that the gas mass flow that results out of that setting relative to a given air mass flow results in a reading relationship of sensor (#1) 25 and sensor (#2) 26 that repeats a combustion result in terms of emissions which has been approved during commissioning process. During commissioning one may have set and approved a discrete number of emissions. Then, one may have created a transfer function that connects the discrete number of sensor readings that correspond with the air mass flow and emission reading into a target curve (third transfer function). With a regulation algorithm, gas flow may be regulated such that measured relationship between sensor #1 and sensor #2 approaches the target relationship.

Sensor (#1) 25 may measure servo air mass flow parallel to the main air flow channel due to a differential pressure over the burner head restriction 39 and the measured flow may have a direct relation to the main air mass flow. Sensor (#2) 26 may measure air mass flow between the air reference point and the intermediate pressure point between channels three and four. As result of gas mass flow, a pressure difference over the burner orifice 51 may occur and form a second pressure difference over the sensing module 15. As a result of the direction of the main gas flow and the matching pressure difference over the burner orifice 51, the gas inlet pressure over the sensing module 15 at the entrance of servo channel three may be higher than the exit pressure downstream of channel four and channel one. The flow resistances in servo channel three and servo channel four may be chosen such that the intermediate pressure is somewhere between the gas inlet 34 pressure and the mixture outlet 28 pressure and lower than the corresponding reference air inlet 27 pressure.

Out of the reading of sensor (#1) 25 and the transfer function, which was derived from the third operating condition, a target reading for sensor (#2) 26 may be calculated. Thus, a target relationship between sensor (#2) 26 reading 32 and sensor (#1) 25 reading 31 may be established.

Both sensor (#1) 25 and sensor (#2) 26 may drift a little bit due to temperature variations, moisture content variations, air pressure variations, aging and so on. The drift may be measured at a defined time interval and/or after each considerable change in burning capacity by closing the check valve 35 according operating condition four. Then a fourth transfer function may be calculated out of the third transfer function and the first correction factor, accordingly to calculate a new, for drift corrected, target reading for sensor (#2) 26.

Relative drift of sensors compared to each other may be determined. Both sensors may drift in a same ratio in the same direction; however, this will likely not be noticed, and it does not necessarily matter for regulation of an air gas mixing ratio.

The reading 32 of sensor (#2) 26 may be compared to the target reading of sensor (#2) 26. The reading 32 of sensor (#2) 26 may be different than the established target reading, thus indicating that the regulated gas mass flow should be adjusted. In case that the reading 32 of sensor (#2) 26 is less than the target of sensor (#2) 26, the gas mass flow is regulated as too large and the stepper motor of the adjustable gas restriction valve 49 may be given the command to close the gas restriction valve 49 with one or more steps.

In case that the reading 32 of sensor (#2) 26 is larger than the target of sensor (#2) 26, then the gas mass flow may be regulated as too low and the stepper motor of the adjustable gas restriction valve 49 may be given the command to open the gas restriction valve 49 with one or more steps.

Pressure regulation versus mixing ratio regulation may be noted. The present control may also be applied regulate gas pressure in a fixed relation with a reference air pressure. Also, combustion chamber pressure may be used as a reference for controlling. Gas pressure might be regulated with final objective to precisely control gas and air mixing ratio.

Main air flow may pass only one flow resistance (indicated as baffle plate resistance or burner head 51 resistance) while it may flow from reference air pressure to combustion pressure.

Symbol 125 indicates a stored function F(S2/S1). One may use transfer function S2=F(S1) relation virtually everywhere from readings 31 and 32. A measurement of S~2 from reading 32 may be indicated by symbol 126. A correction for drift of the stored function indicated by symbol 125 may be noted at symbol 27 and result in a target S~2 at symbol 128. A difference of measured S~2 from symbol 126 and target S~2 from symbol 128 may be noted as an error at symbol 129. To correct for the error, an adjusting of a mass flow restriction valve 49 may be effected as indicated in symbol 130.

Figure 11:
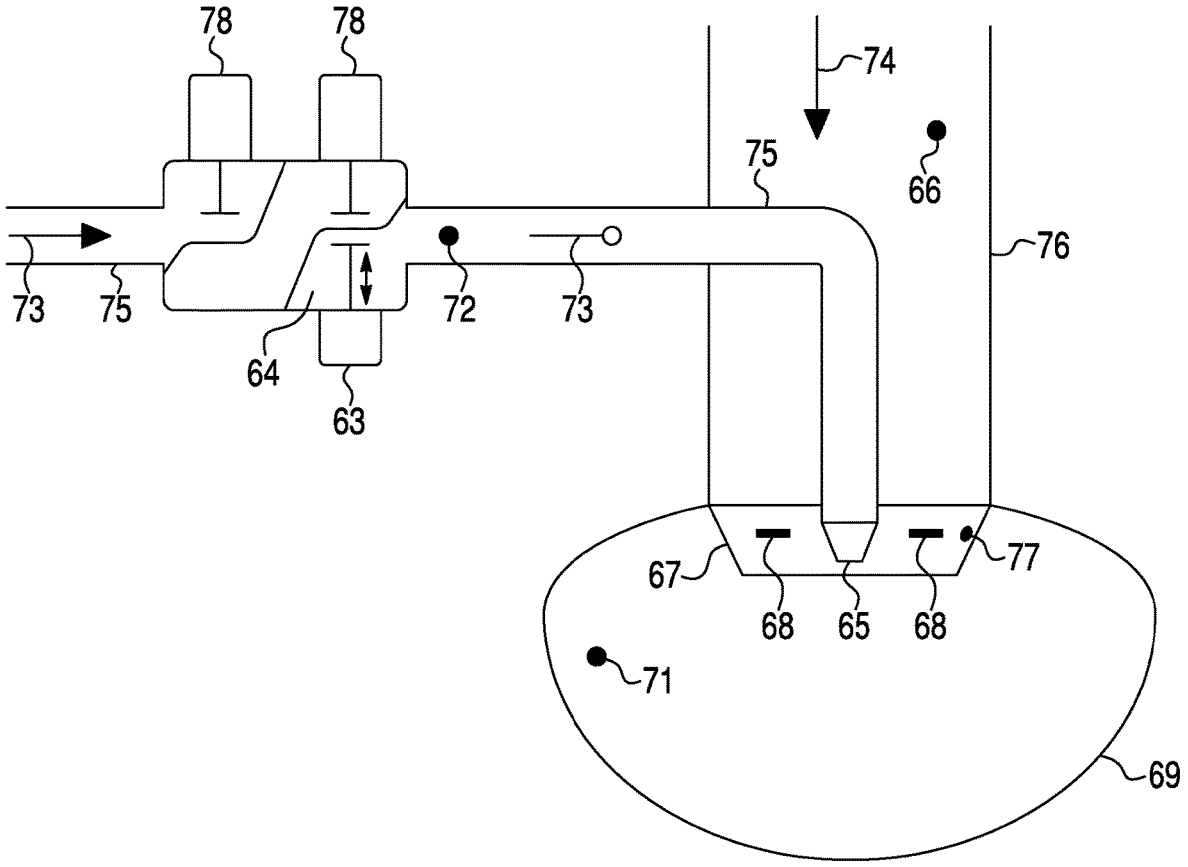
FIG. 11 is a diagram showing where a regulation control regulates gas pressure at a pick-up point for gas pressure directly downstream of the pressure regulator.

FIG. 11 is a diagram showing where regulation control regulates gas 73 pressure at a pick-up point 72 for gas pressure directly downstream of the pressure regulator (pressure regulation valve 64 control). The pressure control system may be mounted downstream in channel 75 from stepper motor 63 driven gas pressure regulation valve 64 and upstream from a burner orifice 65 or gas injector. An air 74 supply/reference at pick-up point 66 for air pressure may be taken in a channel 76 downstream of a fan or air restriction valve and upstream of a burner head 67 and/or baffle plate 68. A combustion chamber 69 reference at pick-up point 71 for combustion pressure may be taken downstream of burner orifice 65 and downstream of burner head baffle plate 68. Air flow resistance may be present at point 77. Gas channel 75 may have one or more safety shut-off valves 78.

Figure 12:
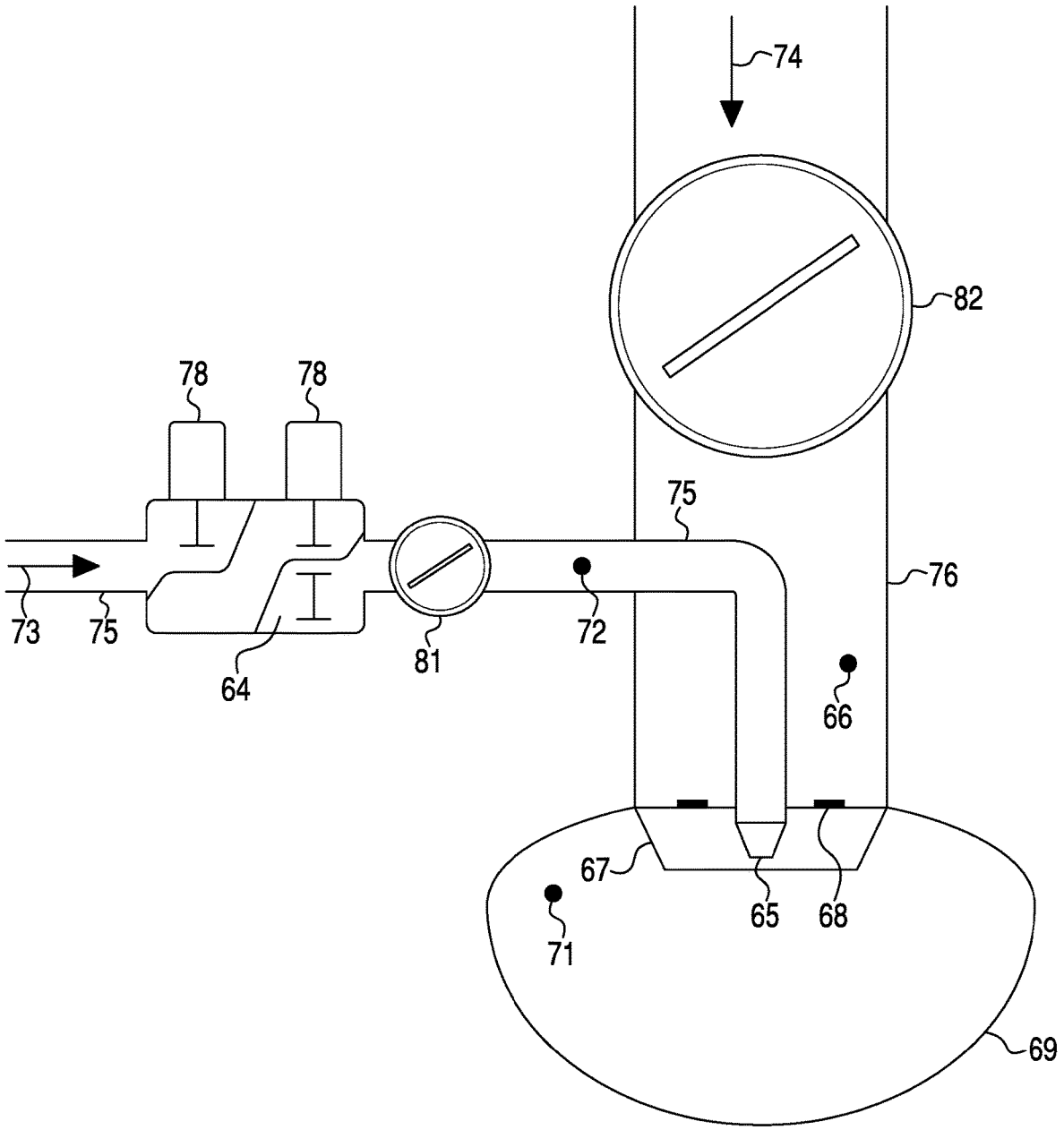
FIG. 12 is a diagram of an example where regulation control is applied as independent feedback to guard positions of an air restriction valve and a gas restriction valve in a so-called parallel positioning system.

FIG. 12 is a diagram of an example where regulation control is applied as mechanically independent feedback to guard positions of an air restriction valve 82 and a gas restriction valve 81 in a so-called parallel positioning system. For instance, there may be a gas butterfly valve 81 (fuel valve) and an air butterfly valve 82 (air valve).

A pressure control system may be used to generate a mechanically independent feedback signal in case of a parallel positioning system. For each combination of butterfly valve positions, a unique combination of sensor readings may exist. The present system may utilize a pressure difference over the burner orifice 65 (gas side) and a pressure difference over the burner head 67 (air side), just like virtually all other systems, that provide input for regulation or guarding the system.

For a parallel position system, there may be no need for a stepper motor 63 driven pressure regulator. The pressure regulator may receive its commands from a different system. There might be no need for an embedded pressure regulator at all as the sensors at pick-up points 66, 71 and 72, may provide signals to the restriction valves 81 and 82 to correct for small errors that typically occur due to building pressure regulator characteristics.

On the other hand, as the present system may provide flow related feedback, in contradiction to valve position related feedback from other systems known from the related art, a stepper driven embedded pressure regulator that receives its feedback from a pressure sensor may be applied in combination with the present burner control system. An advantage of this combination may be that a system with extremely high turn-down (ratio between maximal flow and minimal flow in the range of 100:1 or higher) can be achieved while some typical drift or tolerance may be allowed for the pressure sensor.

An approach may be to record flow sensor 25 and 26 readings 31 and 32, respectively (FIG. 1), for different pressure levels during commissioning and store those combinations for later use. Depending on heat demand, the pressure may be regulated at some level and the present control system may read air flow and regulate matching a gas flow precisely. One may note that flow resistances in the main flows between node 1 (air input) and node 5 (air and gas mixing point) and between node 4 (gas input) and node 5 are not necessarily known. For this, the relationship between two sensor readings 31 and 32, corresponding with the required combustion result that is measured during commissioning with a $CO_2$ meter or an $O_2$ meter, or the like, may need to be recorded during commissioning.

One may note that only plain air flows through both sensors 25 and 26. Variation in chemical content of the applied gaseous fluid will not necessarily affect pressure regulation based on sensor readings.

Accessibility, signal feedback and adjustability may be considered. Virtually all required input and output signals may be lead via a controller to an embedded or external display/processor that can display results and that can receive commands from the installer. The display/processor may be a laptop, smart-phone, burner controller or dedicated handhold tool. There is necessarily no need to access screws, or read signals close to the valve inside the burner cover. A connection cable may be mounted at an easy to reach position, but input, output signals may also be transferred via a wireless device during commissioning.

One may want to lock, secure and fixate settings. Virtually all input and output commands may be monitored. An ability to adjust settings may be password protected. Passwords may be coupled to installer accounts. Revision control may be applied for settings. A list may be made that shows who did what change at what time together with recorded combustion results. For non-authorized persons, the readings may be visible but any adjustment possibility can be blocked.

Manual adjustment may be avoided. Virtually all mechanical adjustment devices may be excluded from the present system. There is necessarily no throttle that needs adjustment, no mechanical amplifier that needs adjustment, and no pneumatic amplifier that needs adjustment (adjustable throttle).

The upstream pressure regulator, such as one in a gas channel, which receives its commands from a controller, may be stepper motor driven, like items 63 and 64 in FIG. 11, and the result of this stepper driven pressure regulator valve may be guarded by the pressure control system. The stepper driven pressure regulation valve may need no external adjustment.

However, some manual adjustment may be possible. The installer may enter or change a desired CO2 result, or an O2 or other emission combustion result as function of burner capacity. The installer may enter a desired start up setting. The CO2 curve or O2 curve may be non-linear if desired.

There may be semi-automatic commissioning. A commissioning procedure may be captured in software and need only some guarding from the installer while it is applied automatically. The procedure may incorporate steps: 1) Read the wished combustion result as a function of burner capacity; 2) Establish initial setting at low flow; 3) Read combustion result from temporary attached combustion sensor as CO2 meter or O2 meter; 4) Determine direction to adjust gas flow and pressure to get to the required combustion result; 5) Store readings of flow sensors for optimal setting; 6) Store reading of flow sensors for limit settings; 7) Repeat for higher burner capacities until a maximum burner capacity is reached; 8) Validate settings; 9) Detach temporary combustion sensor; and 10) Repeat combustion after commissioning according stored data.

Tolerances, rate of curvature of combustion result, outer limits, and so on, may be captured in software. Required actions, based on emission readings, may be captured in software. No special skills or patience are necessarily demanded from the installer.

There may be full automatic commissioning as noted herein. A commissioning procedure may be captured in software and need only some guarding from the combustion sensor which may be connected downstream of the combustion chamber measuring flue gases. Measured combustion emissions may be compared with target combustion emissions. The measured emission reading may differ from the target emission readings and an error may be established hence a second correction factor may be established. A fifth transfer function may be calculated out of the third transfer function, the first correction factor and the second correction factor to calculate a target reading for sensor (#2) as a function of sensor (#1) reading.

There is no necessary need for special orifices with tight tolerances, regardless of any tolerance the system is commissioned at and relation between sensor readings is captured. One significant thing for the system to perform well may be repeatability and resolution. Repeatability may be checked during a pre-purge system check and resolution may be chosen as appropriate.

Diagnostics may be considered. High gas pressure may be detected while the stepper motor driven pressure regulator has received the command to fully close while still a sensor reading being measured indicates that a gas pressure level is too high. Low gas pressure may be detected while the stepper motor driven pressure regulator has received a command to fully open while still a sensor reading being measured that indicates a gas pressure level is too low. Low air pressure does not necessarily have to be detected as the mixing ratio may be air-gas proportional. Air flow may be measured and regardless of the level of that flow, the appropriate amount of gas flow may be regulated. However, it may be possible to store the fan speed and or the air restriction valve position together with sensor readings and detect any mismatch as soon as it occurs. The same may account for any other mismatch in air flow due to voltage fluctuations, changing fan or air restriction valve characteristics, chimney characteristics, and so on. Any change due to blocked filters, blocked orifices, sensor drift may be detected during pre-purge check. Plugged air filters 20 and 30 may be detected by noting that sensor readings for sensor (#1) and sensor (#2) gradually reduce over time during pre-purge check. Change of chemical content of gaseous fluid does not necessarily affect a mixing ratio more than (related art) comparable systems in the field. Typically, the gas suppliers may keep a Wobbe index, meaning that specific heat capacity over density remains about the same. Mixing ratios may remain between certain limits, which can be tested and approved with so-called limit gases.

Air flow may be measured and with the two sensor readings 31 and 32 (FIG. 1), and with help of feedback from CO2 levels or CO levels, the gas flow may be calculated accurately and monitored over time.

Validation measurements may be helpful. Measurements may be performed on a tube model with orifices inside and differential pressure sensors connected. Gas sided pressure may be treated as leading where gas pressure is manually adjusted, to achieve a predefined amplification ratio, respectively 2:1, 1:1, 5:1 and 10:1. The tube model may bleed flow to the environment, which can mean an absence of increased combustion chamber pressure. Calibration characteristics may be measured by disconnecting gas pressure channel upstream from the orifices and bleeding a flow to environment.

Settings may be chosen for validation measurements. Test setup orifices may be normal stamped production orifices for gas side upstream at 0.28 mm, gas side downstream at 0.66 mm, air side upstream at 0.28 mm, and air side downstream, in series with a sensor 1, at 0.66 mm. Sensor 1 may be at a channel to combustion chamber at a 500 Pa range, Sensirion SDP 620. Sensor 2 may be at a channel between air and gas at a 500 Pa range, Sensirion SDP 620. No orifice should be between the gas and air tubes.

Figure 13:
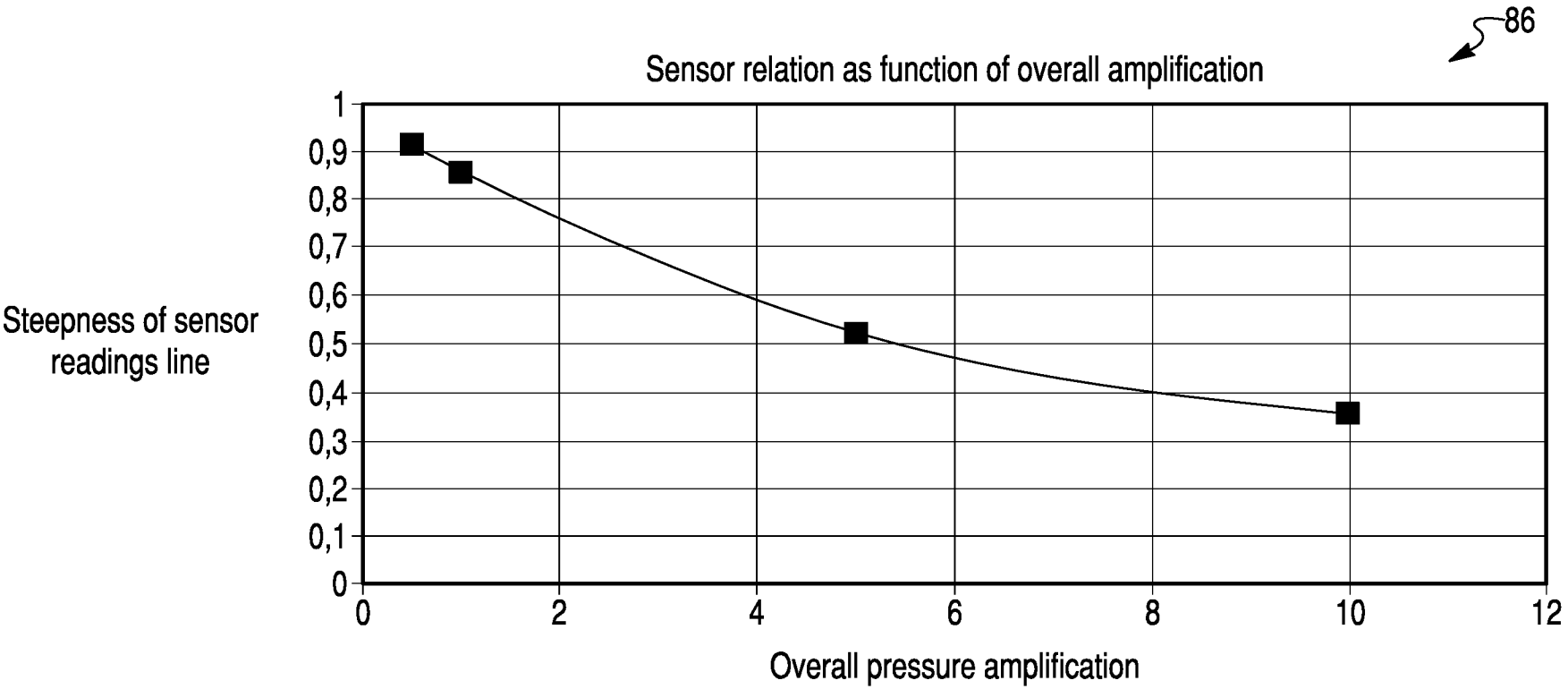
FIG. 13 is a diagram of a graph a sensor relation as a function of an overall amplification.

FIG. 13 is a diagram of a graph 86 a sensor relation as a function of an overall amplification. Graph 86 may plot steepness of a sensor reading line versus overall pressure amplification. When overall pressure amplification is approximately known, for instance, from an installation specification, it may be easy to find initial settings for the sensor readings with the curve as shown in the diagram of graph 86. As an example, an overall amplification may be expected to be about 4. Steepness of the specific curve that matches may be approximately 0.6, assuming for the moment that lines cross the origin virtually in an exact fashion.

For a given fan speed (and corresponding air pressure), an initial gas pressure setting may be regulated at a sensor reading 1, and a sensor reading 2 may equal 0.6 of sensor reading 1. After an initial start-up, the setting may be fine-tuned with feedback from a temporarily attached combustion result meter.

In conclusion, salient features of the present system and approach may be reviewed. The present system may measure air flow with a first servo mass flow sensor 25 or differential pressure sensor as a reference for the heat capacity to the burner chamber being accurate over the whole envisioned flow capacity range. The present control system may measure the ratio of the gas and air manifold pressures with a second flow sensor 26 or differential pressure sensor such that only an air flow passes the sensor and such that the system is capable to regulate gas pressure in the range from about 0.4 times the air pressure until about 9 times air pressure.

Just plain air should flow through the sensors, and any embedded fail safe protocol of the sensor may remain valid. Any significant error or drift in the sensor may be detected, measured and corrected for. Pollution or plugging of the gas filters may be detected, measured and compared to a defined threshold. During commissioning, the sensor readings may be stored in the system and secured for diagnostics later on. Transfer functions may be derived from the stored values to generate target values for regulation, correction, and safety decisions. Optionally, a combustion sensor may be applied to measure content of flue gases. The reading of the combustion sensor may be applied to fine-tune or to update specific transfer functions for regulation. During pre-purge and during run time operation, the readings of the sensors may be checked and compared to each other in relation to a stored value to detect any shift or mismatch. During pre-purge, virtually any pollution of the gas side filter or gas side orifice may be checked and measured by comparing two situations to a known situation. Also, since the sensors are coupled directly to the air and fuel, the system is no longer necessarily sensitive to certain failure modes (i.e., regulator drift or obstructed air supply). The system may also have desired flexibility. Virtually any fuel air curve may be programmed and stored in the controller, no matter how non-linear.

In a standard burner configuration where a fan is used to inject air into the burner under pressure, there may be a manifold for gas and a manifold for air coming into the burner. A first bypass channel may be connected to the air supply downstream of the air control valve or fan, but upstream of the burner baffle plate and then to the combustion chamber. In the bypass channel, there may be a first flow sensor and optionally one orifice. This may be referred to as a first measurement channel. A second bypass channel may be connected to the air supply downstream of the air control valve or fan, but upstream of the burner baffle plate and then to the combustion chamber. In the bypass channel, there may be two orifices. The two orifices in series may form a pneumatic circuit commonly referred to as an air pressure divider. A purpose may be to reduce air pressure to a lower level which is needed for the system to reach minimum amplification factor (gas pressure minus combustion chamber pressure over air pressure minus combustion chamber pressure, (Pgas−Pcc)/(Pair−Pcc)=minimal). First and second bypass channels may also be combined to one air bypass channel with two orifices and one sensor.

A third bypass channel may be connected to the gas supply downstream of the control valve, but upstream of the burner orifice and then to the combustion chamber. In the bypass channel there may be two orifices. The two orifices in series may form a pneumatic circuit commonly referred to as a gas pressure divider. The purpose of this circuit may be to reduce the gas pressure in the bypass channel from the manifold pressure to some pressure that is suitable for the whole required pressure amplification range and between minimal and maximal flow capacity lower than reduced air pressure. Between the two orifices of the air pressure divider circuit and the two orifices of the gas pressure divider circuit there may be a connection. The connection may be referred to as the second measurement channel. In the measurement channel, there may be a mass flow or differential pressure sensor and optionally an orifice. This sensor may measure a magnitude of the flow through the measurement channel or the differential pressure, and provide feedback to the systems controller. The readings of the two sensors may be stored, during commissioning of the application, in a table for the required flow capacity range and for the required amplification range, which can be used by the microprocessor to give an accurate steering signal to the actuator that drives the pressure regulation valve to restore the actual reading at any later time to those readings that are initially stored in the table.

The readings of the two sensors during pre-purge, where the gas valve is closed, may be stored in a table. The stored readings and the ratio between the actual readings at any later time may be used as a reference to detect sensor drift over time.

Also, a sensor embedded safety protocol may be utilized as only plain air flow passes the sensor during operation. The system constituting the sensor, measurement channel, bypass channel, pressure divider, fuel control valve, and controller may be located in a single body, may be all individual items, or may make up any combination. Optionally, a combustion sensor may be added to the control system for increased ease of system setup and for improved control accuracy during operation. This sensor may have to be placed in the flue of the combustion chamber or other appropriate location to observe the byproducts of combustion. Another optional feature may be a temperature addition of temperature sensor(s) to measure the air and gas temperature. If this information is available to the system controller, then the temperature (density) effects on the system mass flows may be compensated out. The temperature compensation may or may not involve separate temperature sensors as many readily available pressure and flow sensors have built-in temperature compensation.

To set up the present system in the field, the burner may be adjusted between minimum and maximum fire and the combustion byproducts can be observed (either manually or by the control itself if it has its own combustion sensor). The excess air may be adjusted to the desired amount at each point on the fuel/air curve between min and max fire, and the output of the sensors in the measurement channels may be recorded and stored by the controller.

This process may be repeated until the entire fuel/air curve has been profiled and stored. Once the controller has this curve, it may position the air damper and the pressure regulation valve precisely based on the desired firing rate of the system and the feedback from the sensors in the measurement channels.

To recap, a burner control system may incorporate a first mass flow sensor having a first port connectable to an air supply, a second port, and a signal terminal; a second mass flow sensor having a first port connectable to the air supply, a second port, and a signal terminal; a first coupling point having a first port connected to the second port of the second mass flow sensor, a second port connectable to a fuel source, and a third port; a second coupling point having a first port connected to the second port of the first flow sensor, a second port connected to the third port of the first coupling point, and a third port connectable to a combustion chamber; and a processor having a first terminal connected to the signal terminal of the first mass flow sensor and a second terminal connected to the signal terminal of the second mass flow sensor, and having a third terminal connectable to a control terminal for the fuel source.

The fuel source may incorporate a variable restriction device having a first port for connection to a fuel supply, and a second port for connection to the second port of the first coupling point; and an actuator connected to the variable restriction device, and having the control terminal connected to the third terminal of the processor.

A signal to the control terminal of the actuator may vary a restriction of the variable restriction device to a flow of fuel through the variable restriction device.

The system may further incorporate a first restriction device in serial connection with the first mass flow sensor between the air supply and the first port of the first coupling point, a second restriction device in serial connection with the second mass flow sensor between the air supply and the first port of the second coupling point, a third restriction device connected between the fuel source and the second port of the first coupling point, and a fourth restriction device connected between the third port of the first coupling point and the second port of the second coupling point.

The system may further incorporate each of one or more fifth restriction devices having a first port connected to the second port of the first coupling point and having a second port, and each of one or more shut off devices having a first port connected to the second port of the one or more fifth restriction devices, respectively, and having a port connectable to the fuel source.

The system may further incorporate a shut off device connected between the fuel source and the second port of the first coupling point, and an actuator connected to the shut off device and having a control terminal connectable to a fourth terminal of the processor.

The system may further incorporate a first filter connected between the air supply and the first ports of the first and second mass flow sensors, a second filter connected between the fuel source and the second port of the first coupling point, and a third filter connected between the third port of the second coupling point and the combustion chamber.

The second coupling point may have a fourth port connectable to the air supply and fifth port connectable to the fuel source.

The system may further incorporate a shut-off valve connected between the fuel supply and the first port of the variable restriction device, and a second actuator connected to the shut-off valve and having a control terminal connected to a fourth terminal of the processor.

The system may further incorporate a first restriction device connected between the air supply and the fourth port of the second coupling point, and a second restriction connected between the second port of the variable restriction device and the fifth port of the second coupling point.

The combustion chamber may have a first terminal connected to a fifth terminal on the processor, and a second terminal connected to a sixth terminal on the processor; and the first terminal may provide a signal indicating a magnitude of emissions from the combustion chamber.

A burner control mechanism may incorporate a processor; a first mass flow sensor having a first port connectable to an air supply, and a signal terminal connected to the processor; and a second mass flow sensor having a first port connectable to the air supply, and having a signal terminal connected to the processor; a first coupling point having a first port connected to the second port of the second mass flow sensor, having a second port and a third port; a second coupling point having a first port connected to the second port of the first mass flow sensor, a second port connected to the third port of the first coupling point, and having third port connectable to a combustion chamber; a shut-off device having a first port connected to the second port of the first coupling point and having a second port; an actuator connected to the shut-off device and having a terminal connected to the processor; a variable restriction device having a first port connected to the second port of the shut-off device and having a second port; an actuator connected to the variable restriction device, and having a terminal connected to the processor; a shut-off valve having a first port connectable to a fuel supply and a second port connected to the second port of the variable restriction device; and an actuator connected to the shut-off valve and having a terminal connected to the processor.

The mechanism may further incorporate a first connection having a restriction between the first port of the variable restriction device and a fourth port of the second coupling point, and a second connection having a restriction between the air supply and a fifth port of the second coupling point.

The shut-off valve may be closed via a signal from the processor to the actuator of the shut-off valve, and data from the first and second mass flow sensors may be taken and provided to the processor for storage and reference.

The shut-off valve may be opened and fuel be provided to the second coupling point, Feedback emissions signals from one or more sensors situated in or proximate to the combustion chamber may be provided to the processor. The variable restriction device may be adjusted with a signal from the processor, based on data from the terminals of the first and second mass flow sensors provided for storage and reference and feedback emissions signals from the one or more sensors, to regulate fuel to the combustion chamber where the fuel is mixed with air for combustion to occur in the combustion chamber.

The shut-off valve may be opened and the fuel supply may be connected to the second coupling point. The processor may derive a signal based on stored data from the first and second mass flow sensors, and the stored emissions data from one or more sensors situated in or proximate to the combustion chamber. The signal may be provided to the actuator of the variable restriction device for adjustment of the variable restriction device to affect the combustion to reduce emissions from the combustion chamber to a predetermined reference level.

The processor may incorporate a diagnostic component connected to the signal terminals of the first mass flow sensor and the second mass flow sensor. The processor may incorporate an indicator that determines whether a high pressure or low pressure exists according to signals from the signal terminals. The low pressure and high pressure may be determined according to predetermined reference levels. The diagnostic component may make automatic corrections for detected system errors, such as from a check of a valve function.

A combustion control arrangement may incorporate a sensing module connectable to an air supply; a processing module connected to the sensing module; a first connection point connected to the sensing module; a second connection point connected to the sensing module and the first connection point, and connectable to a combustion chamber; one or more emissions sensors situated in or proximate to the combustion chamber, and connected to the processing module; and a variable restriction device connected to the first connection point, the second connection point, the processing module, and connectable to a fuel supply.

Data from the sensing module may be provided to the processing module. Data fed back from the one or more emissions sensors may be provided to the processing module. The processing module may provide a signal, based on the data from the sensing module and the one or more emissions sensors, to the variable resistance device to adjust resistance to a flow of fuel that affects combustion in the chamber to reduce emissions to a predetermined reference level.

Data from the sensing module may be stored by the processing module. Data from the one or more emissions sensors may be stored by the processing module. The processing module may provide a signal, based on the stored data from the sensing module and stored data from the one or more emissions sensors, to adjust resistance to a flow of fuel to affect combustion in the chamber to reduce emissions to a predetermined reference level.

In the present specification, some of the matter may be of a hypothetical or prophetic nature although stated in another manner or tense.

Although the present system and/or approach has been described with respect to at least one illustrative example, many variations and modifications will become apparent to those skilled in the art upon reading the specification. It is therefore the intention that the appended claims be interpreted as broadly as possible in view of the related art to include all such variations and modifications.

What is claimed is:

1. A burner control mechanism comprising:

a processor;

a first mass flow sensor having a first port connectable to an air supply, a second port, and a signal terminal connected to the processor; and a second mass flow sensor having a first port connectable to the air supply, a second port, and a signal terminal connected to the processor;

a first coupling point having a first port connected to the second port of the second mass flow sensor, a second port, and a third port;

a second coupling point having a first port connected to the second port of the first mass flow sensor, a second port connected to the third port of the first coupling point, and a third port connectable to a combustion chamber;

a shut-off valve having a first port connected to the second port of the first coupling point and a second port;

an actuator connected to the shut-off device and having a terminal connected to the processor;

a variable restriction device having a first port connected to the second port of the shut-off device and a second port;

an actuator connected to the variable restriction device, and having a terminal connected to the processor;

a shut-off valve having a first port connectable to a fuel supply and a second port connected to the second port of the variable restriction device;

an actuator connected to the shut-off valve and having a terminal connected to the processor;

a first connection having a restriction between the first port of the variable restriction device and a fourth port of the second coupling point; and a second connection having a restriction between the air supply and a fifth port of the second coupling point.

2. The mechanism of claim 1, wherein:

the shut-off valve is closed via a signal from the processor to the actuator of the shut-off valve; and data from the first and second mass flow sensors are taken and provided to the processor for storage and reference.

3. The mechanism of claim 2, wherein:

the shut-off valve is opened and fuel is provided to the second coupling point;

feedback emissions signals from one or more sensors situated in or proximate to the combustion chamber are provided to the processor; and the variable restriction device is adjusted with a signal from the processor, based on data from the terminals of the first and second mass flow sensors provided for storage and reference and feedback emissions signals from the one or more sensors, to regulate fuel to the combustion chamber where the fuel is mixed with air for combustion to occur in the combustion chamber.

4. The mechanism of claim 2, wherein:

the shut-off valve is opened and the fuel supply is connected to the second coupling point;

the processor derives a signal based on stored data from the first and second mass flow sensors, and the stored emissions data from one or more sensors situated in or proximate to the combustion chamber; and the signal is provided to the actuator of the variable restriction device for adjustment of the variable restriction device to affect the combustion to reduce emissions from the combustion chamber to a predetermined reference level.

5. The mechanism of claim 1, wherein:

the processor comprises a diagnostic component connected to the signal terminals of the first mass flow sensor and the second mass flow sensor;

the processor comprises an indicator that determines whether a high pressure or low pressure exists according to signals from the signal terminals;

the low pressure and high pressure are determined according to predetermined reference levels; and the diagnostic component can make automatic corrections for detected errors.

6. A burner control mechanism comprising:

a processor;

a first mass flow sensor having a first port connectable to an air supply, a second port, and a signal terminal connected to the processor; and a second mass flow sensor having a first port connectable to the air supply, a second port, and a signal terminal connected to the processor;

a first coupling point having a first port connected to the second port of the second mass flow sensor, a second port, and a third port;

a second coupling point having a first port connected to the second port of the first mass flow sensor, a second port connected to the third port of the first coupling point, and a third port connectable to a combustion chamber;

a shut-off valve having a first port connected to the second port of the first coupling point and a second port;

an actuator connected to the shut-off device and having a terminal connected to the processor;

a variable restriction device having a first port connected to the second port of the shut-off device and a second port;

an actuator connected to the variable restriction device, and having a terminal connected to the processor;

a shut-off valve having a first port connectable to a fuel supply and a second port connected to the second port of the variable restriction device;

an actuator connected to the shut-off valve and having a terminal connected to the processor; and wherein:

the processor comprises a diagnostic component connected to the signal terminals of the first mass flow sensor and the second mass flow sensor;

the processor comprises an indicator that determines whether a high pressure or low pressure exists according to signals from the signal terminals;

the low pressure and high pressure are determined according to predetermined reference levels; and the diagnostic component can make automatic corrections for detected errors.

7. The mechanism of claim 6, further comprising:

a first connection having a restriction between the first port of the variable restriction device and a fourth port of the second coupling point; and a second connection having a restriction between the air supply and a fifth port of the second coupling point.

8. The mechanism of claim 7, wherein:

the shut-off valve is closed via a signal from the processor to the actuator of the shut-off valve; and data from the first and second mass flow sensors are taken and provided to the processor for storage and reference.

9. The mechanism of claim 8, wherein:

the shut-off valve is opened and fuel is provided to the second coupling point;

feedback emissions signals from one or more sensors situated in or proximate to the combustion chamber are provided to the processor; and the variable restriction device is adjusted with a signal from the processor, based on data from the terminals of the first and second mass flow sensors provided for storage and reference and feedback emissions signals from the one or more sensors, to regulate fuel to the combustion chamber where the fuel is mixed with air for combustion to occur in the combustion chamber.

10. The mechanism of claim 8, wherein:

the shut-off valve is opened and the fuel supply is connected to the second coupling point;

the processor derives a signal based on stored data from the first and second mass flow sensors, and the stored emissions data from one or more sensors situated in or proximate to the combustion chamber; and the signal is provided to the actuator of the variable restriction device for adjustment of the variable restriction device to affect the combustion to reduce emissions from the combustion chamber to a predetermined reference level.

* * * * *